US007810345B2

(12) United States Patent
Nebbia et al.

(10) Patent No.: US 7,810,345 B2
(45) Date of Patent: Oct. 12, 2010

(54) REFRIGERATING APPARATUS WITH A LIQUID SUPPLY SYSTEM

(75) Inventors: Fabio Nebbia, Giarole (IT); Costanzo Gadini, Frassineto Po (IT); Giovanni Perucca, Casale Monferrato (IT); Fiorenzo Pivetta, Casale Monferrato (IT)

(73) Assignee: ELTEK S.p.A., Casale Monferrato (Alessandria) (IT)

( * ) Notice: Subject to any disclaimer, the term of this patent is extended or adjusted under 35 U.S.C. 154(b) by 451 days.

(21) Appl. No.: 11/908,761

(22) PCT Filed: Mar. 13, 2006

(86) PCT No.: PCT/IB2006/000617

§ 371 (c)(1),
(2), (4) Date: Sep. 14, 2007

(87) PCT Pub. No.: WO2006/097838

PCT Pub. Date: Sep. 21, 2006

(65) Prior Publication Data

US 2008/0168791 A1 Jul. 17, 2008

(30) Foreign Application Priority Data

Mar. 15, 2005 (IT) ..... TO2005A0164

(51) Int. Cl.
*F25D 23/12* (2006.01)

(52) U.S. Cl. ..... 62/338; 62/389; 222/146.6

(58) Field of Classification Search ..... 62/337–339, 62/389–400; 222/146.6
See application file for complete search history.

(56) References Cited

U.S. PATENT DOCUMENTS

| | | | | |
|---|---|---|---|---|
| 2,536,009 | A | 12/1950 | Morrison et al. | |
| 2,544,394 | A * | 3/1951 | Muffly | 62/267 |
| 2,781,153 | A * | 2/1957 | Roberts | 222/183 |
| 2,942,432 | A * | 6/1960 | Muffly | 62/155 |
| 3,208,641 | A * | 9/1965 | Brugioni | 222/108 |
| 5,135,645 | A | 8/1992 | Sklenak et al. | |
| 5,325,679 | A | 7/1994 | Tatematsu et al. | |
| 5,490,547 | A * | 2/1996 | Abadi et al. | 141/359 |
| 5,542,265 | A * | 8/1996 | Rutland | 62/389 |
| 7,549,299 | B2 * | 6/2009 | Kolb Filho et al. | 62/338 |

FOREIGN PATENT DOCUMENTS

EP 1486745 A 12/2004

OTHER PUBLICATIONS

International Search Report for PCT/IB2006/000617 dated Jul. 31, 2006.

* cited by examiner

*Primary Examiner*—William E Tapolcai
(74) *Attorney, Agent, or Firm*—Heslin Rothenberg Farley & Mesiti P.C.

(57) ABSTRACT

A refrigerating apparatus, particularly a household refrigerator, has a liquid-supply system for a user device forming part of the apparatus, particularly a dispenser of a consumable product. The apparatus further comprises a protection system arranged for preventing flooding deriving from possible leakage of liquid, in particular from at least one of said supply system and said user device.

18 Claims, 15 Drawing Sheets

Fig. 19
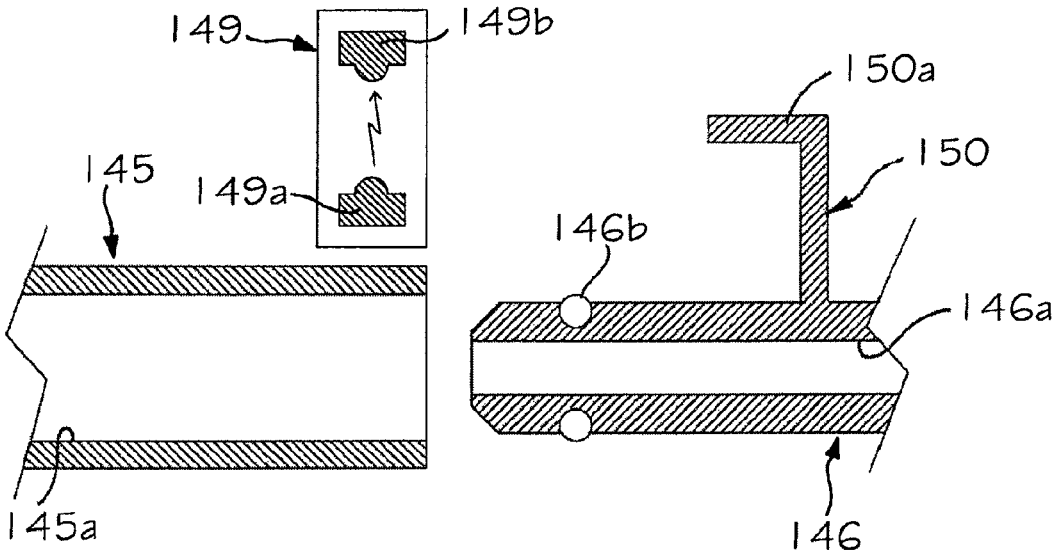
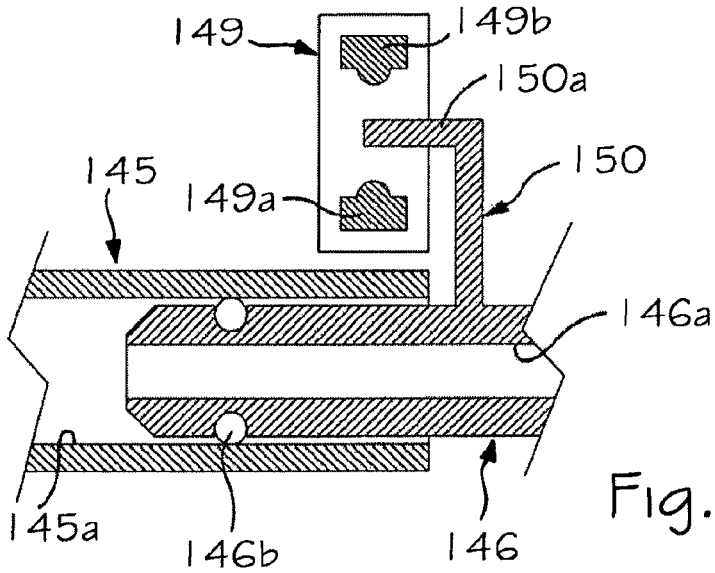
Fig. 20

REFRIGERATING APPARATUS WITH A LIQUID SUPPLY SYSTEM

CROSS REFERENCE TO RELATED APPLICATIONS

This application is a national stage of PCT International Application No. PCT/IB2006000617, filed on Mar. 13, 2006, and published in English on Sep. 21, 2006, as WO 2006/097838, which claims priority to Italian Application No. TO2005A000164, filed on Mar. 15, 2005, the entire disclosures of which are incorporated herein by reference.

The present invention relates to a refrigerating apparatus, particularly a household refrigerator, having a liquid-supply system Certain refrigerating apparatuses, and in particular some types of household refrigerators, are equipped with a dispenser of a generic consumable product with a liquid base, such as a beverage, water or ice cubes.

In the case of a dispenser of liquid products, the supply means typically comprise a tank for the liquid itself, from which there branches off a pipe that terminates in a dispenser with nozzle, the latter projecting in the top part of a compartment made in a door of the refrigerator. Also the tank is typically located in the door of the refrigerator, so as to find itself in a position corresponding to one of its compartments, so that the liquid accumulated may be constantly kept at a relatively low temperature. Along the aforesaid pipe, provided between the tank and the nozzle dispenser is a valve of a normally-closed type, which may be controlled via a suitable control means, such as a lever or a push-button set within or in the proximity of the aforesaid compartment. In order to deliver the liquid product, a user positions a container within the aforesaid compartment, underneath the nozzle, and actuates the control means, which thus enables opening of the delivery valve.

The tank can be conceived for manual or else automatic topping-up. In the first case, the tank is equipped with an opening for filling, possibly provided with a plug, through which the user has the possibility of periodically pouring of the new water or other liquid into the tank. In the second case, the tank is instead equipped with a respective supply pipe, connected to a domestic water system. Provided along the aforesaid supply pipe is a solenoid valve, and operatively associated to the tank is a level sensor, for example, of the floating type. In said embodiment, when the sensor detects the reduction in the level of the water in the tank below a minimum threshold, the control system of the refrigerator enables opening of the solenoid valve, in order to allow fresh water to come into the tank, through the supply pipe. The solenoid valve is then brought back into a closed condition when the level of the water in the tank rises beyond a maximum threshold, detected by means of the aforesaid sensor.

Also some ice dispensers for refrigerators are equipped with a container for accumulating water, which can be topped up manually or connected to the domestic water system, said container forming part of a device for the formation of ice. In some cases, the system further comprises delivery means for dispensing the ice cubes formed in the aforesaid device, said system being set in an area where the ice cubes can be taken out.

The main purpose of the present invention is to provide a refrigerating apparatus, particularly a household refrigerator, comprising a liquid-supply system, which is of increased operativeness and safety as compared to the prior art of the sector.

The above and other purposes still, which will emerge clearly hereinafter, are achieved according to the present invention by a refrigerating apparatus, particularly a household refrigerator, having the characteristics referred to specifically in the annexed claims, which form an integral part of the descriptive content of the present patent application.

The characteristics and advantages of the present invention will emerge clearly from the ensuing detailed description and from the annexed plate of drawings, which are provided purely by way of explanatory and non-limiting example, and in which.

Figure 16:
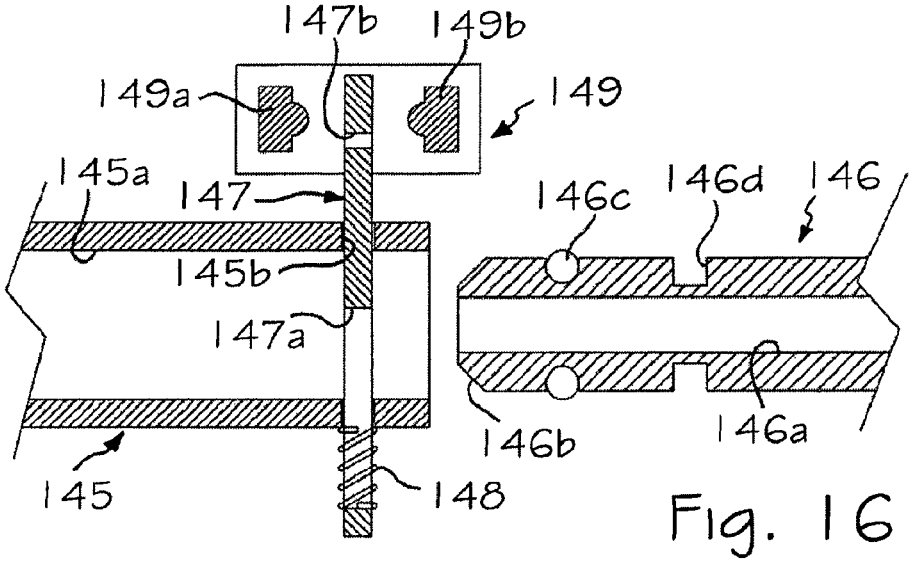
Figure 17:
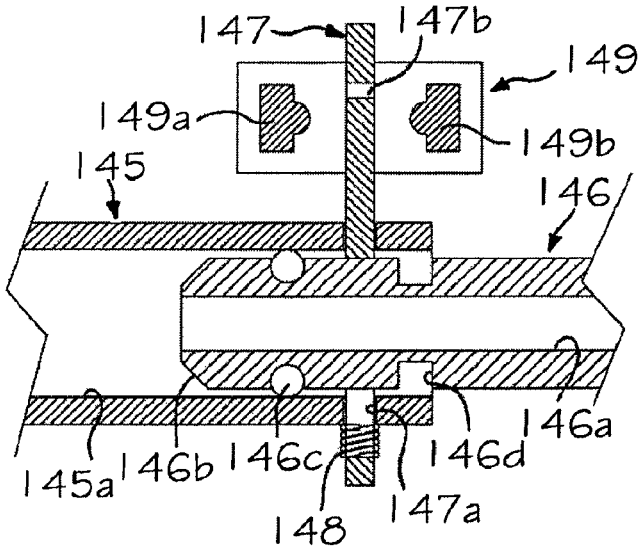
Figure 18:
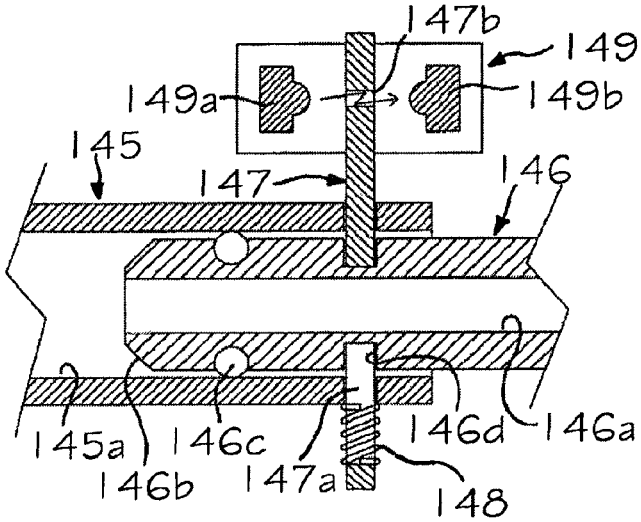

FIGS. 16-18 are schematic cross sections of a system of connectors or coupling fittings, in different possible conditions, equipped with means for detection of the state of the respective connection, it being possible to use said system in an apparatus according to the invention; and FIGS. 19 and 20 are schematic cross-sectional views of another system of connectors or coupling fittings, having the same functions as those of the system illustrated in FIGS. 16-18.

In the figures, the reference number 1 designates as a whole a refrigerating apparatus provided according to the invention. In the case exemplified, the apparatus in question is a domestic refrigerator of a combined type with double door.

Figure 2:
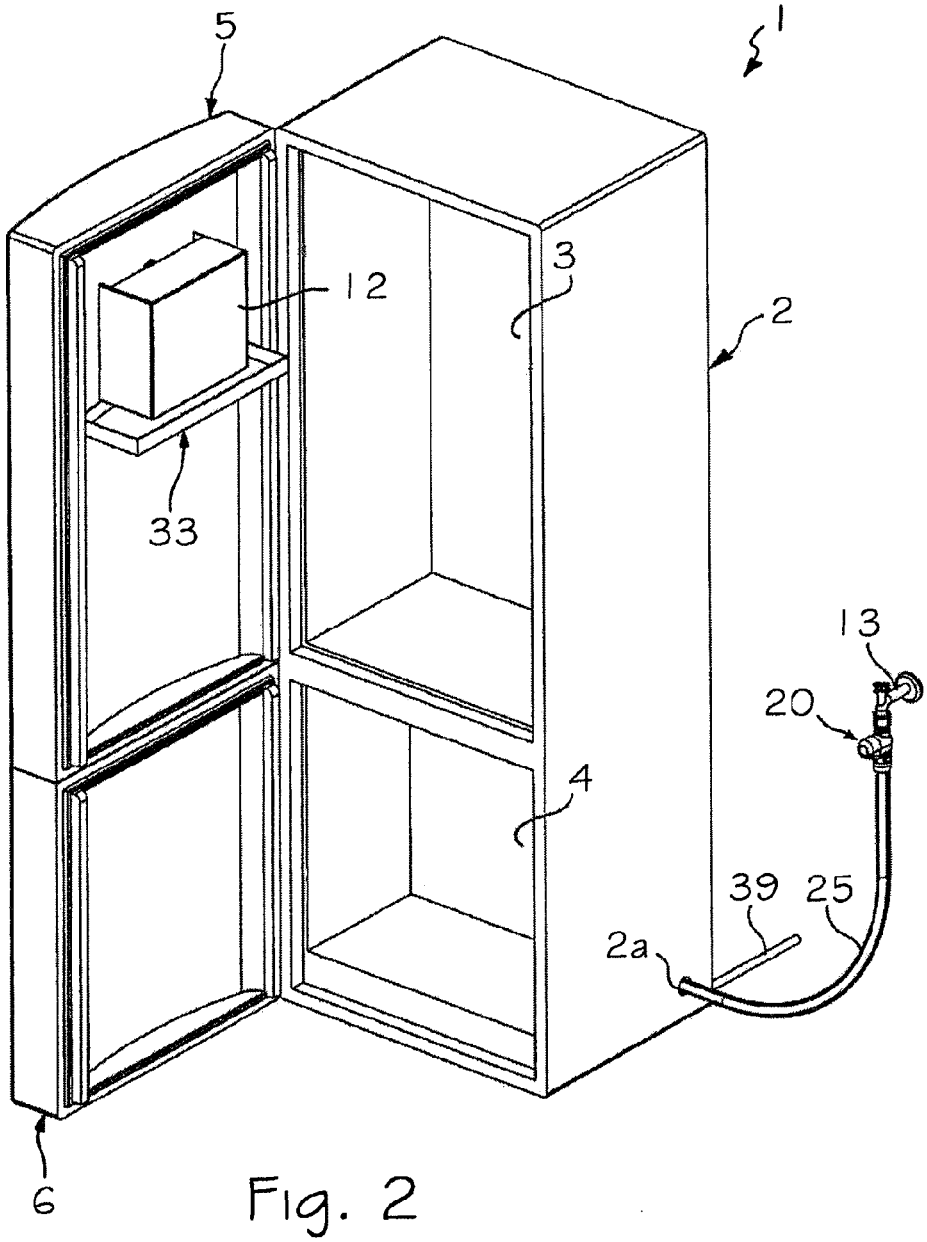

The refrigerator 1 comprises a cabinet 2, defining an upper compartment 3, for example, for conservation of fresh foodstuffs, and a lower compartment 4, for example, for freezing foodstuffs. Hinged in a known way to the cabinet 2 are an upper door 5 and a lower door 6, respectively for the upper compartment 3 and lower compartment 4. The structure of the cabinet 2 is of a generally known type, and hence will not be described in detail in what follows. It should also be noted that in the figures just the elements of the refrigerator 1 strictly necessary for an understanding of the invention are represented. For this reason, for example, in FIG. 2 the inner door panels of the refrigerator and the usual shelves and/or boxes normally present in a normal refrigerator are not illustrated.

Figure 1:
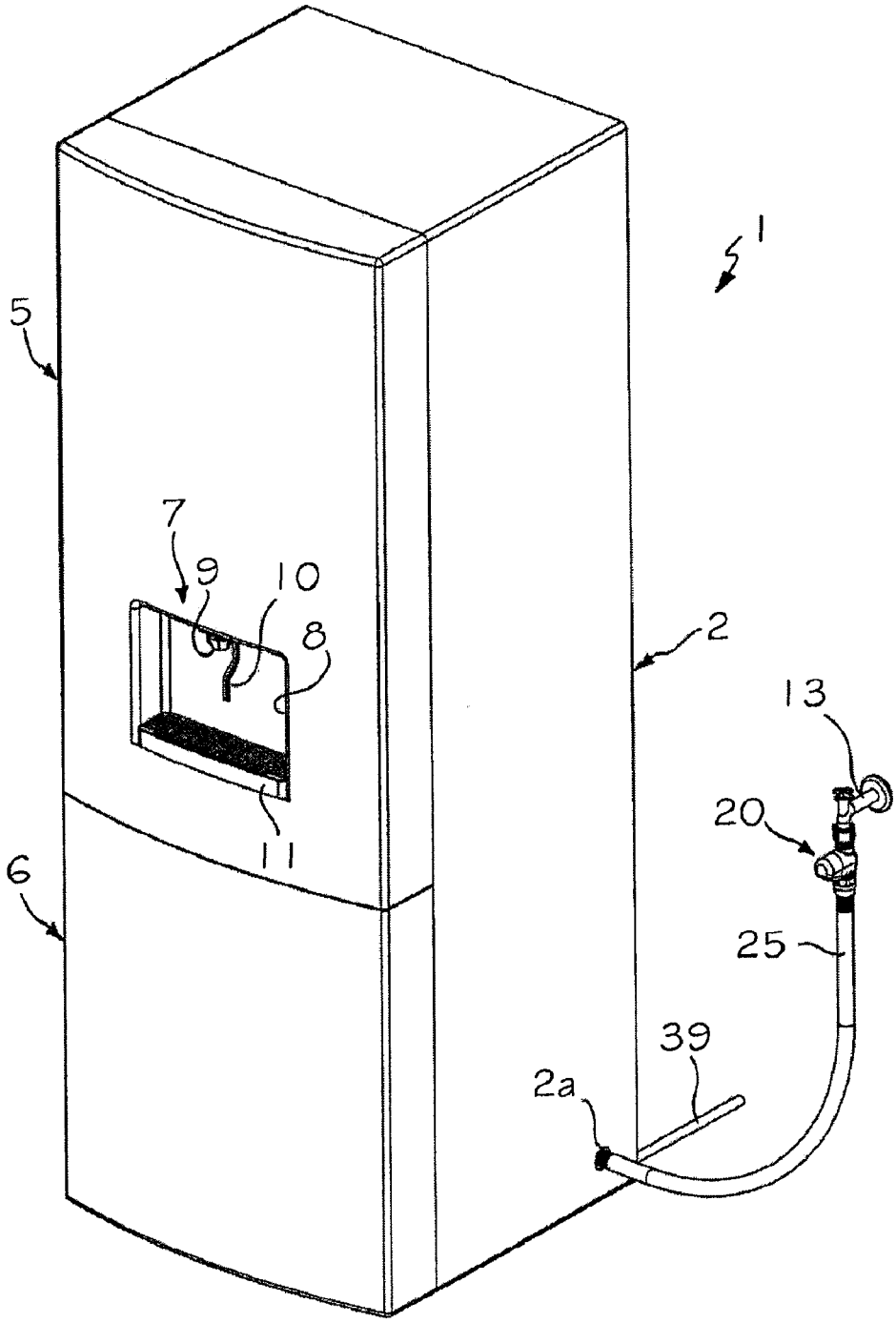
FIGS. 1 and 2 are schematic perspective views of a refrigerating apparatus provided according to the invention with the doors closed and the doors open, respectively.

The refrigerator 1 comprises an arrangement for dispensing beverages, part of which is designated as a whole by 7 in FIG. 1, and in particular for dispensing cooled water. For this purpose, in the outer part of the door 5 there is made a niche or compartment 8, in which projecting from above is a nozzle of a dispenser 9, equipped with an electrically or mechanically actuated valve, and a respective control means 10, here having the form of a lever. Positioned on the bottom of the compartment 8 is a small collector tray, designated by 11. On the other side, as may be seen in FIG. 2, associated to the inner part of the door 5 is, in a position above the compartment 8, a container for accumulating water, here represented by a tank 12. The tank 12 is arranged for supplying water to the nozzle of the dispenser 9, to which it is connected via a tubing.

With the door 5 closed, the tank 12 is in a position corresponding to the compartment 3, so that the water contained in the tank itself may be kept cool, i.e., at a relatively low temperature. For the purposes of delivery, a user must position a container, such as a glass, in the compartment 8 and shift the lever 10, with the consequent opening of the valve of the dispenser 9 and hence outlet of water from its nozzle. In said step, the tray 11 has the function of collecting any water that may overflow from the aforesaid container or that occasionally does not reach it after being delivered from the nozzle. The tray 11 may possibly be removable in order to enable manual emptying-out, for example, into a sink, of the water possibly collected thereby, and/or for periodic cleaning.

In the case exemplified, the refrigerator 1 is connected to a line for external water supply, in order to enable topping-up of the tank 12 with water. For this purpose, connected to a tap or generic attachment 13 of the domestic drinking-water system, is a supply device, designated as a whole by 20. According to an important aspect of the present example of embodiment of the invention, the aforesaid device 20 is configured to form part of a system of protection against flooding of the refrigerator 1, aimed at preventing possible damage deriving from malfunctioning or failure of the liquid-supply system or of the aforesaid dispenser arrangement.

Figure 3:
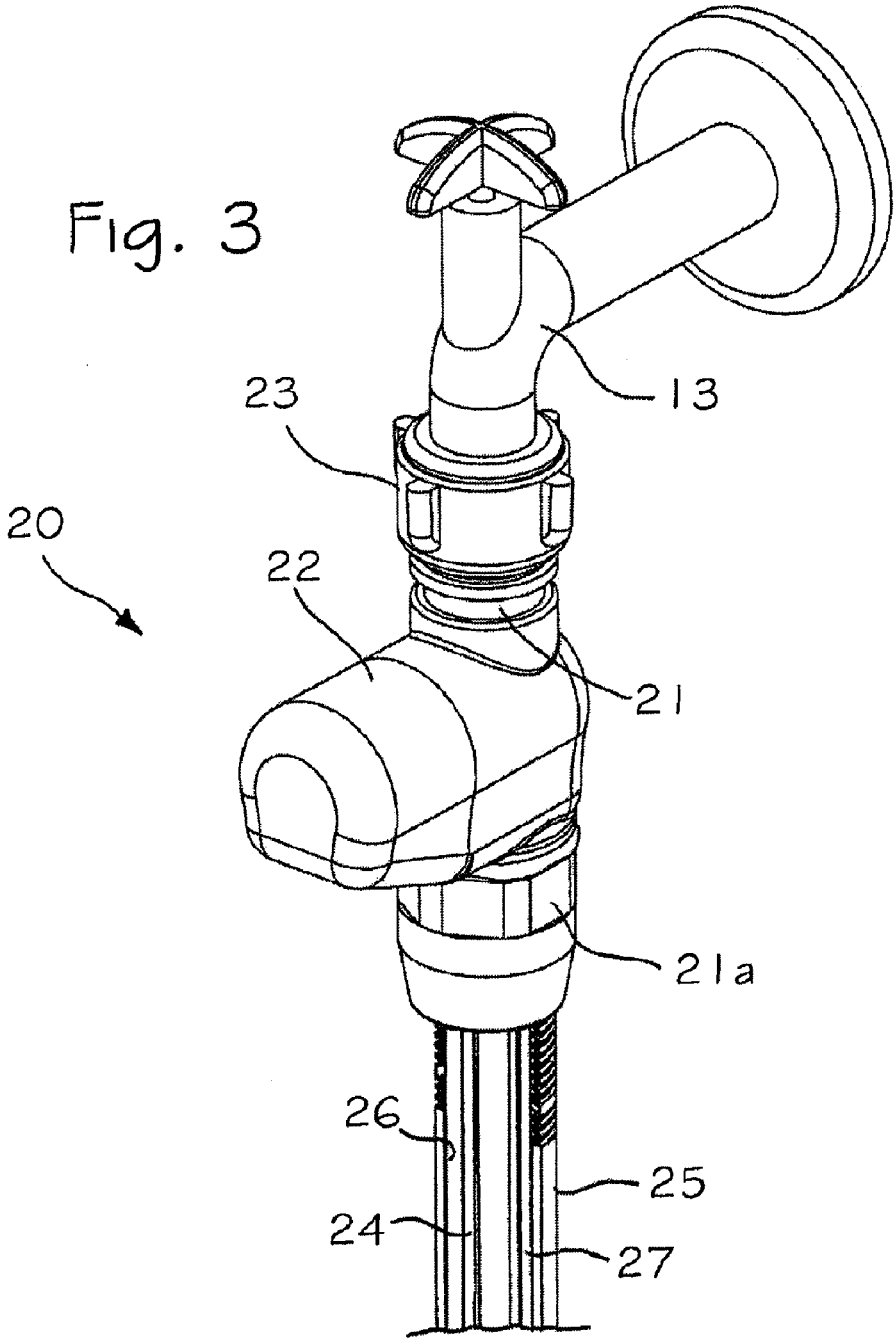
FIG. 3 is a schematic perspective view of a part of a possible water-supply device of the apparatus of FIG. 1.

FIG. 3 represents a part of the supply device 20, equipped with shutoff means for shutting off the water. In the case exemplified, the device 20 comprises a solenoid valve 21, of a generally known conception, of which visible in the figure is just one part of the respective main body, made, for example, of thermoplastic material. Said body defines a respective pipe for passage of the water, along which a shutter member of the valve 21 is operative. Overmoulded on the body of the valve 21 is a protective coating 22, which is also made of thermoplastic material. Mounted in the upper area of the body of the valve 21, which constitutes the inlet stretch of the aforesaid passage for the water, is an external ring nut 23, for coupling to the tap 13. In a position corresponding to its outlet stretch, the aforesaid pipe is instead connected to a rubber tube 24, which is fitted on the bottom end of the body valve 21 and is secured thereto with modalities in themselves known, for example, via a clinching metal ring.

Designated by 25 is a corrugated outer tube, which encloses the tube 24 and has the function of collecting the leakage water in the case of failure of the tube 24. In the gap 26 formed between the tubes 24 and 25 there moreover extend electrical conductors, one of which designated by 27, for supply of the valve 21. In the example illustrated in FIGS. 1 and 2, the tube 25, containing the respective tube 24 and the conductors 27, penetrates within the cabinet 2 via a suitable passage 2*a* of the latter.

Figure 4:
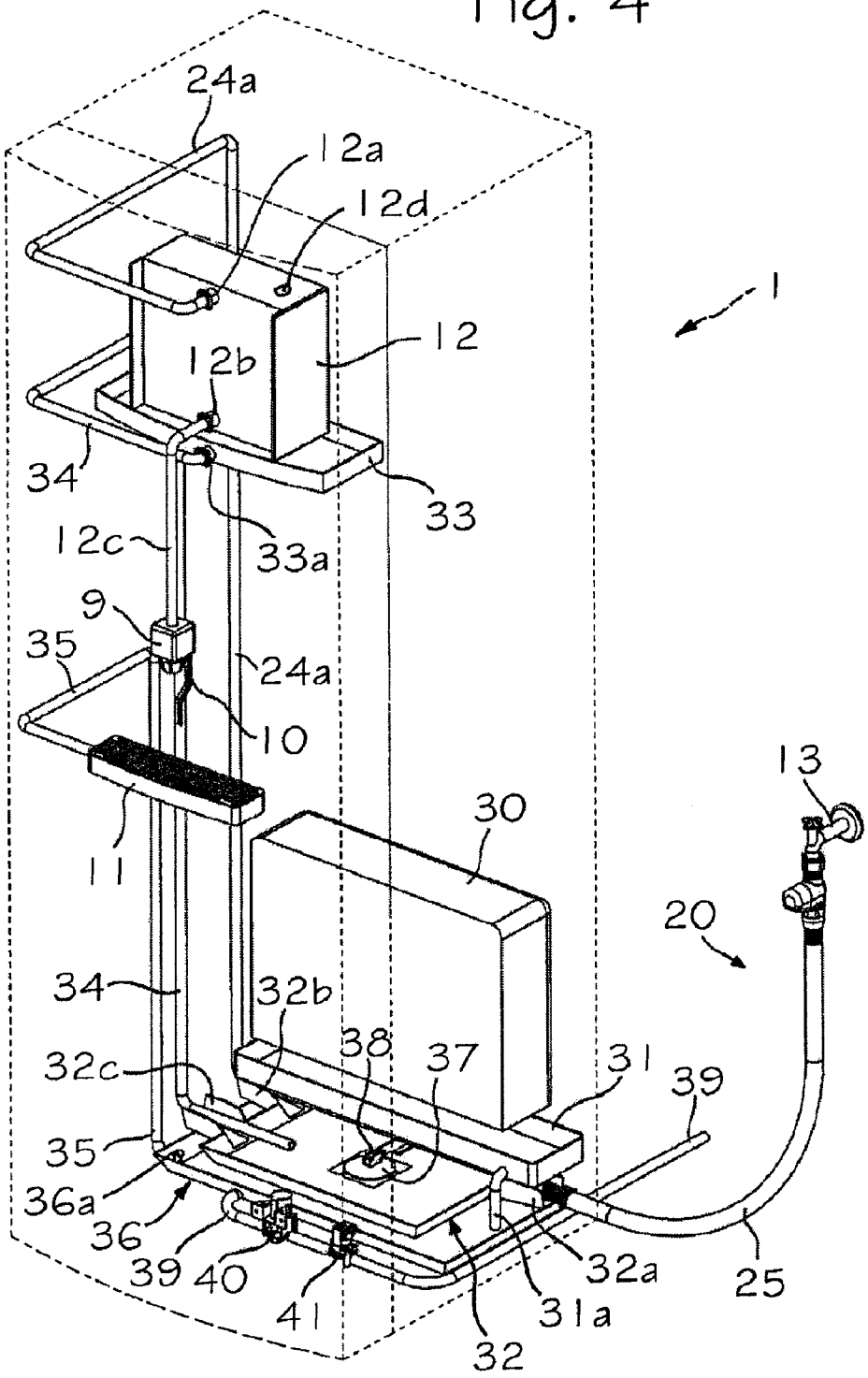
FIG. 4 is a schematic perspective view of a protection system with which the apparatus of FIG. 1 is equipped.
Figure 5:
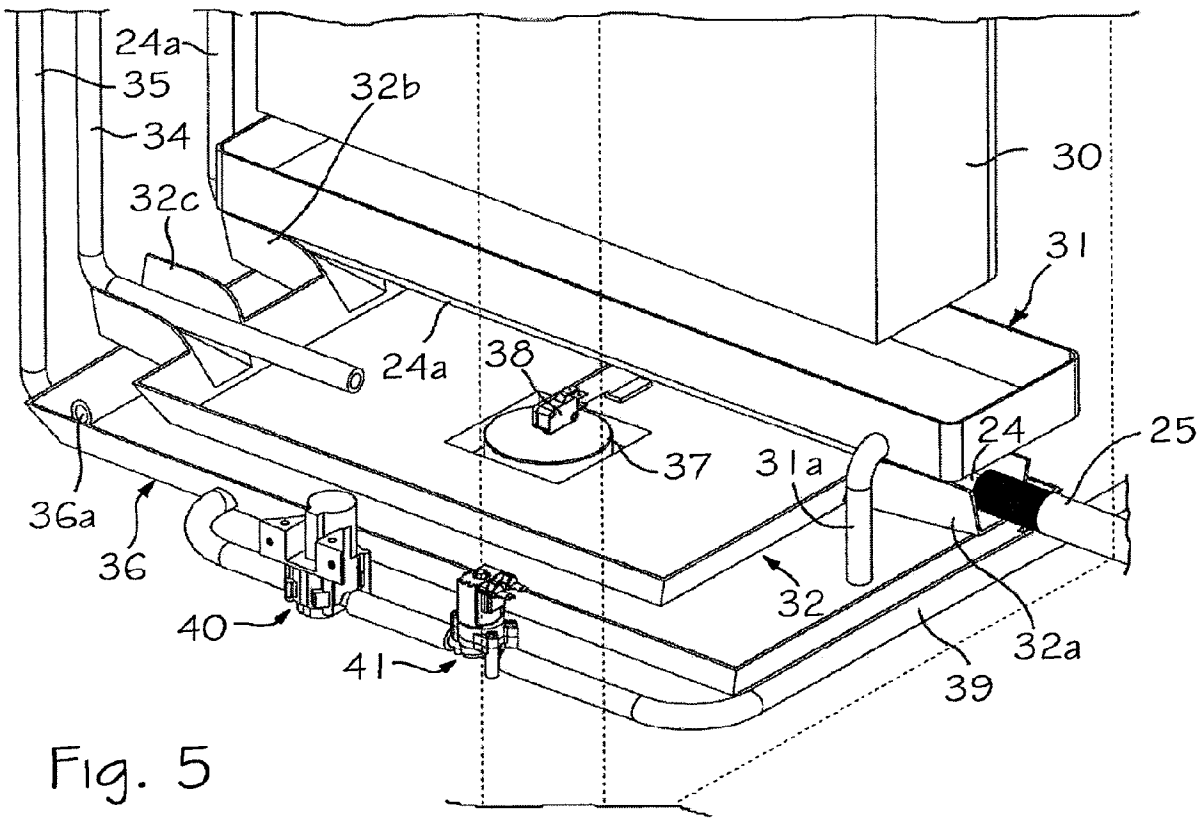
FIG. 5 is an enlarged detail of FIG. 4.

Illustrated schematically in FIGS. 4 and 5 are further components of the aforesaid system of protection against flooding. In said figures the structure of the refrigerator 1 is represented just schematically, by dashed lines.

The refrigerator 1 is equipped with a refrigerating unit of a type in itself known, comprising an evaporator, represented schematically in FIGS. 4 and 5, where it is designated by 30. Positioned as usual underneath the evaporator 30 is a respective tray 31 for collection of any condensate that may form on the evaporator 30 in the course of normal operation of the refrigerator or else following upon cycles of defrosting thereof.

Provided according to an example of the invention is a basin or intermediate tray, designated by 32, having a side portion shaped to provide a first seat 32*a*, positioned within which is the open end of the corrugated outer tube 25 of the device 20 (the other end of the tube 25 is closed in a sealed way, with respect to the coating 22 of the device). The inner tube 24 of the device 20 proceeds instead beyond the aforesaid open end of the outer tube 25 and is connected, via a connector in itself known, to a tubing 24*a*, preferably integrated in the refrigerator 1, where the aforementioned connector and at least part of the tubing 24*a* extend above the tray 32 (see, for example, FIG. 5). The tubing 24*a* extends as far as a second seat 32*b* for positioning the tray itself, and then rises within the structure of the cabinet 2 and passes on the inside of the door 5, as far as a respective inlet union 12*a* of the tank 12, as may be seen in FIG. 4.

Provided in a position corresponding to the stretch that extends between the cabinet 2 and the door 5 is a device in itself known for protection and guiding of the tubing 24*a*, for example, of the bellows type or else of the type integrated in a hinge of the door 5 (see, for example, EP-A-1 191 289). At least in a position corresponding to said device, the tubing 24*a* may be flexible. Preferably, said protection and guide elements for the tube are shaped for collecting or conveying any possible leakage of the liquid in said area.

From FIG. 4 it may moreover be seen how the tank 12 is also equipped with an outlet union 12*b*, connected to which is a tubing 12*c* that terminates in a position corresponding to the nozzle dispenser 9 and/or the corresponding valve. The unions 12*a* and 12*b* can possibly be of a type that can be inserted in a separable way with respect to the tank 12, so that the latter, if need be, may be removed from the door 5, for example, for requirements of cleaning, maintenance or replacement.

Positioned underneath the tank 12 is a tray 33, equipped with a respective union 33*a* for the first end of a tubing 34. Also said union 33*a* can possibly be inserted in a separable way, so as to enable removal of the tray 33. Part of the tubing 34 extends within the door 5, and then passes into the cabinet 2, via a protection and guide device similar to the one provided for the tubing 24*a*, and finally drops as far as the tray 32. For this purpose, the latter is equipped with a third side portion, shaped to provide a seat 32*c* for positioning the terminal stretch of the tubing 34, which opens onto the tray itself.

In the example of embodiment of FIGS. 4 and 5, moreover, also the small tray 11 of the dispenser arrangement 7 is equipped with an union (not visible in the figures) for the first end of a tubing 35. Also part of the tubing 35 extends within the door 5 and then passes into the cabinet 2, via a protection and guide device similar to the one provided for the tubings 24*a* and 34, and then drops as far as a basin or bottom tray 36. The latter is equipped with a side union 36*a*, to which the second end of the tubing 35 is connected.

As emerges from FIGS. 4 and 5, the intermediate tray 32 is operatively positioned at least in part within the bottom tray 36, preferably in order to enable overflow of any excess liquid from the intermediate tray 32 towards the bottom tray 36; alternatively, the two trays could be set at a distance apart from one another and connected via an overflow pipe, or which is, positioned at a pre-defined height of the intermediate tray 32.

From the above figures, it may be moreover noted how the tray 31 is equipped with a respective discharge tube 31*a* that terminates within the bottom tray 36.

Operating within the intermediate tray 32 is a detector device, comprising a sensor means for detecting the presence of liquid, with a respective control means. In the case exemplified, the sensor means comprises a float element 37, operative for producing switching of a microswitch 38, which embodies the aforesaid control means and is an active part of the control system of the refrigerator 1. The detection device including the float 37 and the microswitch 38 is calibrated for detecting the presence, within the tray 32, of a volume of liquid considered potentially dangerous, as will emerge hereinafter.

The trays 32, 36 are positioned in a base of the cabinet 2, arranged for the purpose, or underneath the compartment 4.

Once again in FIGS. 4 and 5, designated by 39 is a discharge pipe (visible partially also in FIGS. 1 and 2), which branches off from the bottom tray 36 and at the other end is connected, for example, to a connector of a domestic sewage system (not represented). Present along the pipe 39 are a discharge pump 40 and a solenoid valve 41 of a normally closed type, both of a conception in itself known and governed by the control system of the refrigerator.

In the aforesaid figures, as likewise in the subsequent ones, the wiring for electrical connection of the various elements to the control system of the refrigerator 1 have not been represented for requirements of greater clarity and in so far as they are of a type in itself known.

As already explained, for the purposes of delivery of cool water, a user positions a glass or other container in the compartment 8, underneath the nozzle of the dispenser 9, and then displaces the control lever 10. This brings about opening of the valve of the dispenser so that the refrigerated water can come out of the respective nozzle. The tank 12 is equipped with a level controller (for example, governed by a float with a magnet and reed sensor, or else of an optical type, or again of a pressure-switch type, etc.), arranged for controlling topping-up of the water in the tank itself. In particular, the aforesaid controller is arranged for detecting dropping of the level of the water in the tank 12 below a predetermined minimum threshold, so that the control system of the refrigerator 1 will consequently enable opening of the valve 21 of the supply device 20. In this way, water coming from the water system can reach the tank 12, via the tube 24 and the tubing 24*a*, in order to enable it to be topped up. Next, the controller detects that the level of water in the tank 12 exceeds a predetermined maximum threshold, and the control system consequently issues a command for closing of the valve 21 of the supply device 20.

The condensate, for example produced by heating of the evaporator 30 during a defrosting cycle of the refrigerator 1, can be collected by the tray 31. The amount of said liquid is typically modest and can usually evaporate in a relatively short time. For this purpose, the tray 31 can conveniently be positioned at least in part on a compressor of the refrigerating system, which normally generates heat, in order to facilitate the aforesaid evaporation. In such a perspective, the discharge tube 31*a* of the tray 31 can function as overflow pipe. In other words, the inlet of the tube 31*a* can be positioned to determine a pre-defined maximum level of filling of the tray 31, upon overstepping of which the excess of condensate that drops back into the tray 31 can pass to the bottom tray 36. It may be noted that said condition must, on the other hand, be considered extremely rare, considering that the volume of condensate that may be generated and accumulate in the course of operation of a refrigerator is very modest. In this regard, it is also pointed out that, in a possible variant, the tray 31 can be omitted in order to exploit the tray 32 and/or the tray 36 directly for collecting the condensate liquid.

Also the water possibly collected in the small tray 11 of the arrangement for dispensing beverages 7 is conveyed, via the tubing 35, into the bottom tray 36. Also said amount of liquid is normally very modest in so far as it is basically due to occasional minor overflow of water from the containers that are each time set in the compartment 8 of FIG. 1 for being filled. Said water then remains within the tray 36, from where it can then evaporate in a natural way. In this connection, in another possible variant, the tubing 35 can terminate in the tray 31 and communicate indirectly with another tray 32 and/or 36 via the small discharge tube 31*a*.

The tray 33 has the function of collecting any possible leakage of water from the tank 12, due, for example, to failure or malfunctioning thereof or of its connectors 12*a*, 12*b*. The tank 12 and the tray 33 are moreover arranged for collecting any outflow of water in the case of any failure or malfunctioning of the level controller of the tank itself, or else of the supply device 20. Suppose, for example, that at the end of topping-up with water, carried out with the previously described modalities, a malfunctioning of the level controller of the tank 12 were to occur, with consequent absence of control of closing of the valve 21 of the supply device 20. In said eventuality, the supply-system water would continue to flow into the tank 12, well beyond its normal threshold of filling, with subsequent overflowing and flooding of the inside of the refrigerator 1. Similar consequences would be encountered in the case where the valve 21 of the device 20 were to remain blocked in the opening condition. For said types of failure, according to the invention, the tank 12 can be equipped with an overflow outlet, designated as a whole by 12*d* in FIG. 4, through which the water in excess can come out of the tank and be collected in the tray 33.

Irrespective of the reasons for leakage or outflowing of water from the tank 12, the water is collected by the tray 33 and conveyed therefrom, via the tubing 34, within the intermediate tray 32. The detection device constituted by the float 37 and the microswitch 38 is arranged so that, in the case where the amount of leakage water collected in the tray 32 exceeds a predetermined level, the control system of the refrigerator 1 brings about closing of the solenoid valve 21 of the device 20 and possibly opening of the solenoid valve 41 and start-up of the discharge pump 40.

In a first possible embodiment, the detection device 37, 38 can be calibrated for detecting a minimum level of leakage liquid, activating immediately closing of the valve 21 of the device 20 to prevent inflow of further water into the tank 12. In the case of malfunctioning of said valve 20, or of its failure to close, the further leakage water collected in the tray 32 overflows from the latter to the tray 36, where additional detection means can be provided, conceptually similar to the ones designated by 37 and 38, which bring about opening of the solenoid valve 41 and start-up of the discharge pump 40. In this way, the water can be evacuated from the tray 36 via the discharge pipe 39, towards the sewage system.

In a second possible embodiment, the detection device 37, 38 can be calibrated for detecting the level of overflowing of the water from the intermediate tray 32 to the bottom tray 36. In this way, the water that overflows from the tray 32 to the tray 36 can be immediately evacuated from the latter via the discharge pipe 39, towards the sewage system. At the same time, closing of the valve 21 of the device 20 is aimed at preventing inflow of further water into the tank 12.

It should be pointed out that in embodiments alternative to the one exemplified, the pump 40 and the solenoid valve 41 may not necessarily both be present. For example, in the case where the tray 36 is located at a greater height than the connector of the sewage system, the pipe 39 can be used for discharging by gravity the leakage liquid present in the tray itself, and hence without the aid of the pump 40, simply by opening the solenoid valve 41. The pump 40 is necessary in order to enable forced discharge via the tube 39 when the connector to the sewage system is located at a greater height than the tray 36.

In order to reduce further the risks deriving from possible malfunctioning of the valve 21, the device 20 can integrate also a similar additional safety valve, driven in closing following upon switching of the microswitch 38, actuated by the float 37. For preventing also flooding due to possible faults of the corresponding electronic control circuit, at least one of the valve 21 and the aforesaid additional safety valve could be connected directly to the detection and/or switching means 37, 38.

The protection system of the refrigerator 1 is moreover conceived for preventing possible flooding due to malfunctioning or failure of the supply device 20. In particular, the possible leakage water due to a failure of the tube 24 is conveyed, via the respective outer tube 25, in the intermediate tray 32, with the detection device 37-38 that operates in the same way just described above in order to activate, if necessary, the solenoid valve 41 and the discharge pump 40, as well as the valve 21 and/or the further safety valve provided in the device 20.

In accordance with a preferred variant embodiment, also the tubing 24*a* that supplies the tank 12 and/or the other tubings of the system can be enclosed in a respective channelling for collection and protection, for example, of conception similar to the corrugated outer tube 25 of the device 20 or in the form of a channel. In said variant, then, the possible leakage water due to a failure of at least one of said tubings, such as the tubing 24*a*, is conveyed by the respective outer channelling into the tray 32, or other seat for collecting designed for the purpose, with an operation similar to the one described above. The aforesaid channelling for collection and protection could also be constituted at least in part by a shaped or box-like part of the structure of the refrigerator 1, such as, for example, a bent metal plate, which likewise should then be discharged in a purposely provided accumulation seat, such as the tray 32 and/or the tray 36. The channelling for collection and protection could also be provided by a sort of prolongation of the seats 32*b*, 32*c*, or else by other seats having a similar shape, which extend along the walls of the refrigerator 1 and in which the tubings are housed.

It should be emphasized that the provision of both of the trays 32 and 36 described previously is to be considered optional, in so far as the functions thereof could be obtained just via the tray 36, equipping the latter with respective positioning seats similar to the ones designated by 32*a*, 32*b*, 32*c*—for the tubes 24, 25 and the tubings 24*a* and 34—and positioning therein the detection device 37-38, calibrated for detecting exceeding of a predetermined level of liquid, for the purposes of control of the solenoid valve 41 and/or of the discharge pump 40, as well as of the valve or valves provided in the device 21. The aforesaid pre-set level will be preferably higher than the typical level of the condensate water that can reach the tray 36 from the tray 31.

FIGS. 6-9 illustrate a variant embodiment of the invention, in which the refrigerating apparatus according to the invention is equipped with at least one fast-coupling system, in particular for the supply device 20.

Figure 6:
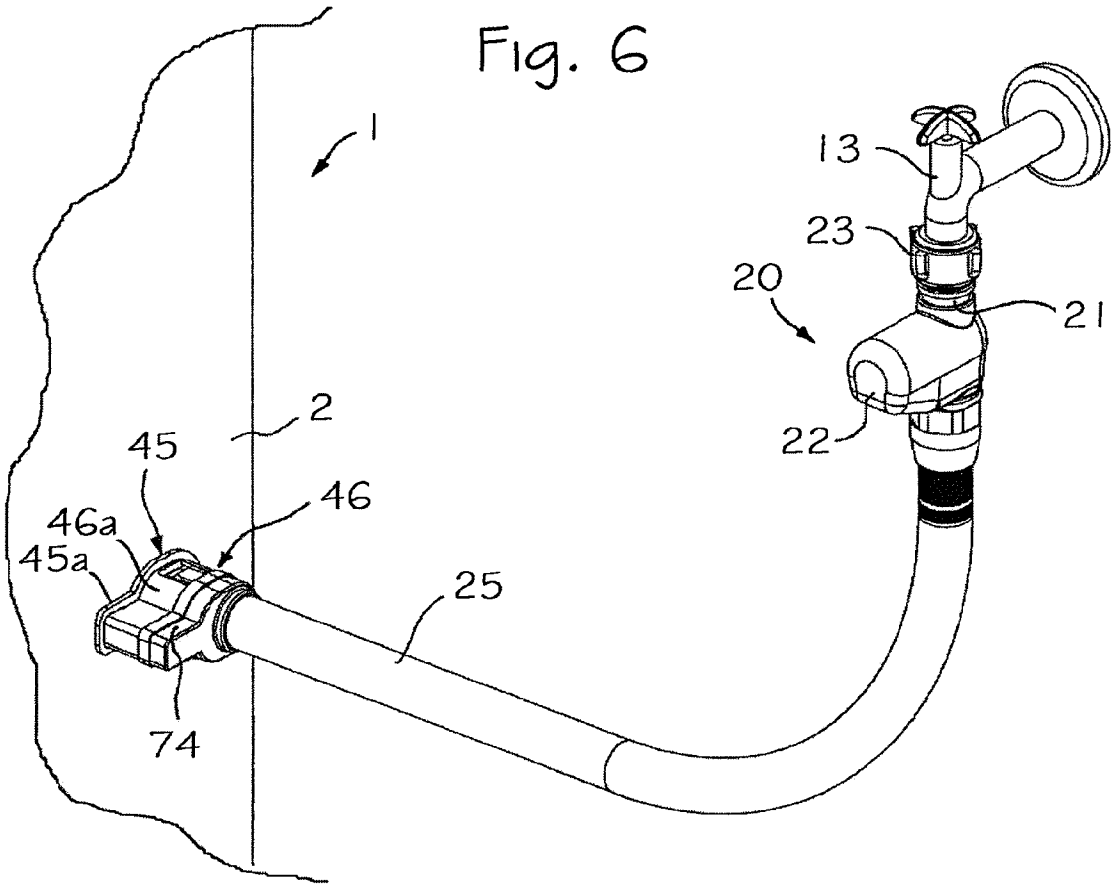
FIG. 6 is a partial perspective view of an apparatus equipped with a water-supply device provided according to a possible variant of the invention.

As may be seen, in particular, in FIG. 6, the aforementioned connection system comprises a fixed connection part 45, associated to the cabinet 2 of the refrigerator 1, and a movable connection part 46, forming part of the device 20. The parts 45 and 46, hereinafter defined for reasons of simplicity as "female connector" and "male connector", are designed for enabling provision in a simple and fast way of the mechanical, hydraulic and electrical connection of the device 20 to the refrigerator 1.

Figure 7:
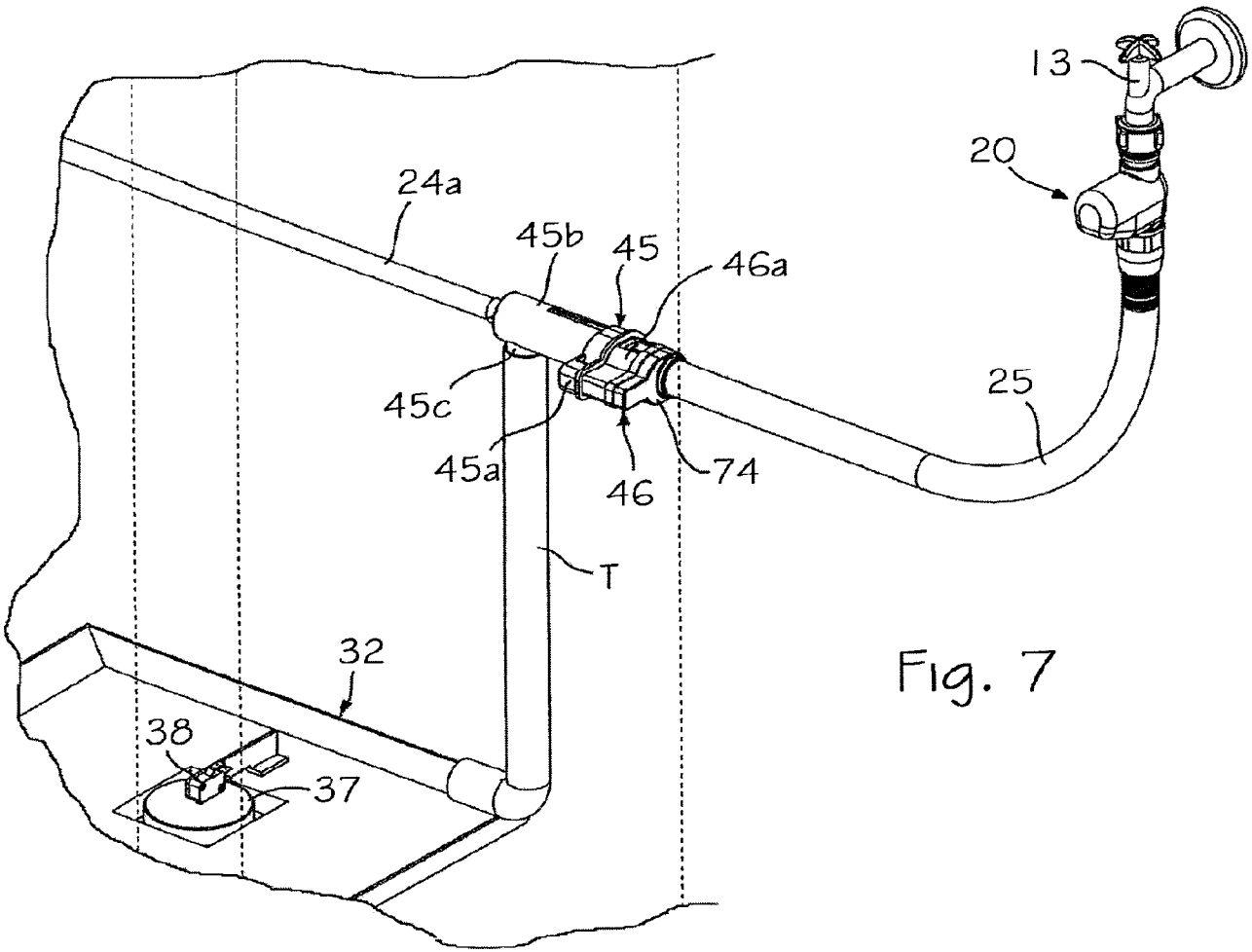
FIG. 7 is a schematic view similar to that of FIG. 6, aimed at illustrating the position, within the apparatus, of some components of the aforesaid water-supply device.

As may be seen particularly in FIG. 7, the female connector 45 has a main body made of insulating material, having a first portion 45*a* accessible from outside the cabinet 2 and substantially prismatic, and a second portion 45*b*, inside the cabinet 2 and substantially cylindrical. Branching off radially from the portion 45*b* is a third body portion 45*c*, to which there is connected a tubing T that gives out into a tray 32.

Figure 8:
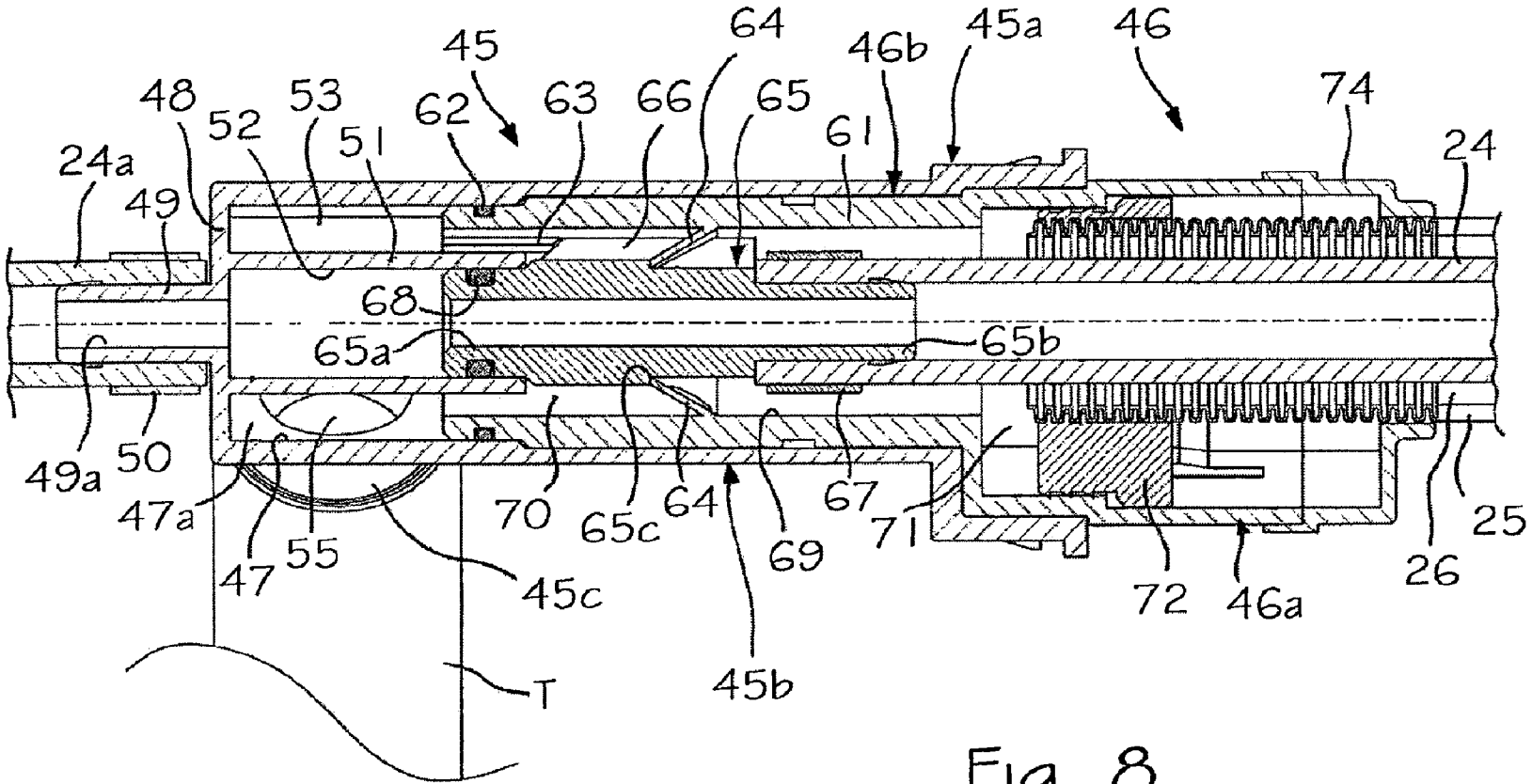
FIGS. 8 and 9 are two schematic longitudinal sections, orthogonal with respect to one another, of a coupling system of the water-supply device illustrated in FIGS. 6 and 7.
Figure 9:
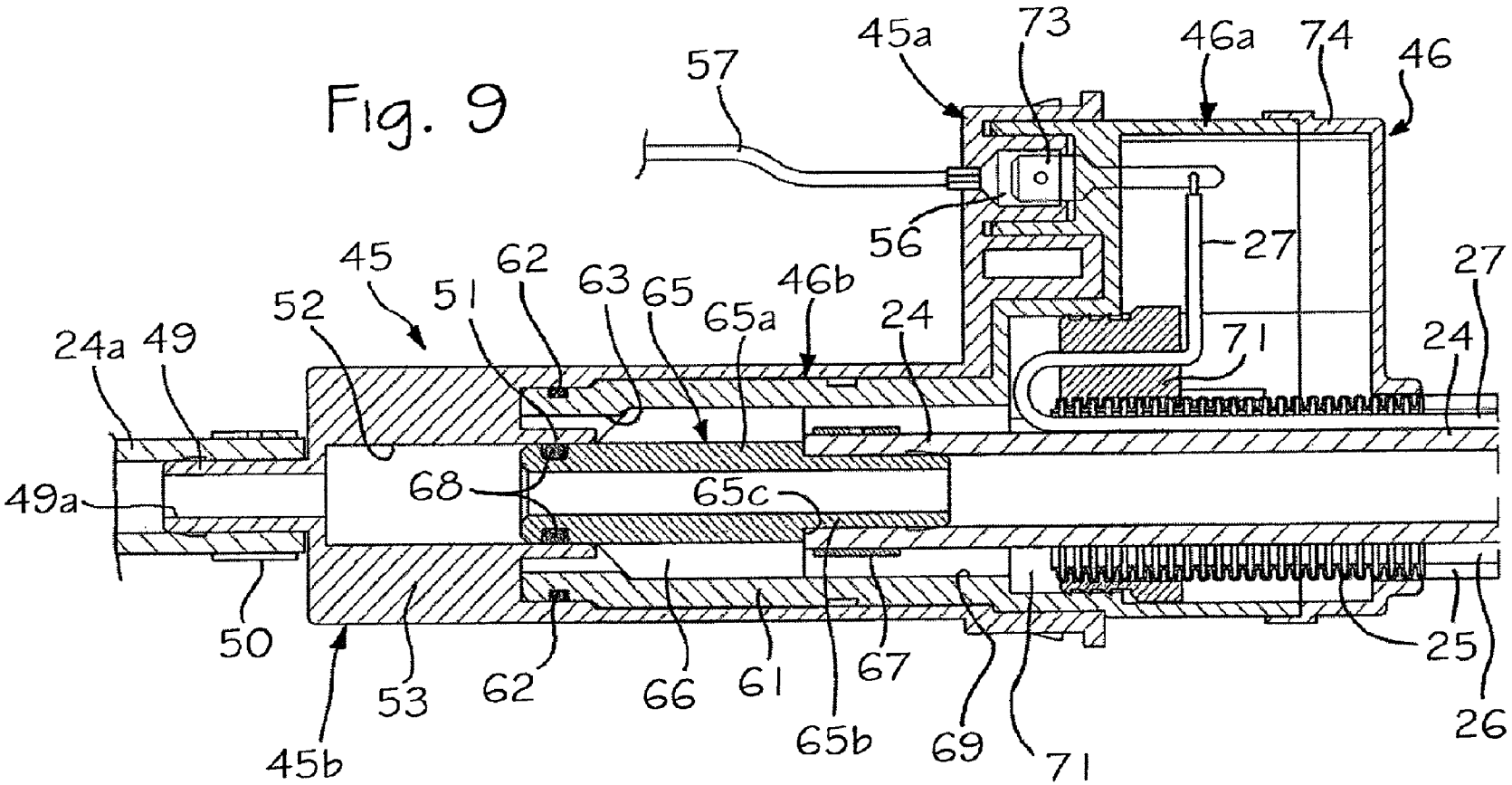

In FIGS. 8 and 9, the system formed by the two male and female connectors 45, 46 is illustrated in two mutually orthogonal cross-sectional views.

The body of the connector 45 has an inner cavity, designated as a whole by 47, with a bottom wall 48 having a passage, in a position corresponding to which is formed a hollow projection 49, projecting outwards. Fixed in a known way, for example, via clinching of a metal ring 50, on said projection 49 is the end of a tubing 24*a* for supply of a tank 12 (see for reference FIG. 3).

Branching off moreover from the wall 48 towards the inner cavity of the body part 45*b*, is a cylindrical wall 51, defining a cylindrical seat 52, which communicates with the cavity 49*a* of the projection 49. Radial reliefs 53 extend between the cylindrical wall 51 and the outer cylindrical wall of the body portion 45*b*.

The cavity part of the connector 45 that surrounds the wall 51, designated by 47*a* in FIG. 8, and in which the reliefs 53 are formed, is in communication with a passage 55 inside the body portion 45*c*. As emerges also from FIG. 6, fitted on the latter is the end part of the tube T, which terminates in a position corresponding to a tray 32 (see again for reference FIG. 4 or FIG. 5). As may be seen in FIG. 9, in the body portion 45*a* of the connector 45 housings are formed for electrical connection terminals, one of which designated by 56, for example, of the female faston type. Said terminals 56 are connected, via respective conductors 57, to a circuit for control and/or electrical supply of the valve 21, and/or of sensor means 21*a* of the device 20, as will emerge clearly hereinafter.

The male connector 46 has a main body made of insulating material having a substantially prismatic part 46*a* and a substantially cylindrical part 46*b* (visible just I FIGS. 8, 9), both of which hollow.

The body portion 46*b* has a cylindrical peripheral wall 61, equipped on the outer side with at least one gasket 62 designed to co-operate in a sealed way with the inner surface of the body portion 45*b* of the female connector 45. Formed on the inner side of the wall 61, in the terminal stretch thereof, are ribbings or reliefs 63 with inclined ends. Once again formed on the inner side of the wall 61, in an intermediate stretch, are engagement tabs 64 (see FIG. 8). Positioned or inserted within the cavity delimited by the cylindrical wall 61 is a hollow insert 65, having a first portion 65*a* and a second portion 65*b*, formed between which is at least one step or engagement seat 65*c*. The portion 65*a* is equipped on the outside with radial tabs 66 having an inclined front surface, whereas fixed, for example via a clinched metal ring 67, on the portion 65*b* is the end of the internal tube 24 of the supply device 20 (see FIG. 3). The portion 65*a* is moreover equipped with gaskets 68, designed to operate in a sealed way on the internal surface of the cylindrical wall 51 of the body portion 45*b* of the female connector 45.

After fixing of the tube 24, the insert 65 is fitted by snap action within the body portion 46*b* of the connector 46, so that the inclined front surface of the radial tabs 66 comes to bear upon the inclined homologous surface of the ribbings or reliefs 63, said insertion thus also bringing about elastic engagement of the engagement tabs 64 on the step or engagement seat 65*c* of the insert itself. The insert 65 is then blocked in position within the body portion 46*b* of the connector 46, so that between the insert 65 with the tube 24 and the cylindrical wall 61 of the body portion 46*b* there is formed a gap 69.

It may be noted that between said cylindrical wall 61 and insert 65 there are in any case defined longitudinal passages, one of which is designated by 70 in FIG. 8, in so far as the tabs 64 are of reduced dimensions and sections, such as not to obstruct the gap 69. Likewise, the reliefs 63 and the tabs 66 are of a shape such as not to obstruct said gap, albeit providing both contrast surfaces and means for centring the items.

Formed in the portion 46*a* of the body of the male connector 46 is a cavity 71, which communicates directly with the gap 69. Terminating within the cavity 71 is the outer tube 25 of the device 20, on which an elastic element 72 is fitted, for example, made of rubber. Said elastic element 72 operates in a sealed way, on one side, on the tube 25 and, on the other side, with respect to surfaces that delimit the cavity 71, in particular on the internal surface of the portion 46*a*. The seal element 72 is then equipped with one or more auxiliary passages for the cable or the conductors 27 that traverse the inside of the gap 26 formed between the tubes 24 and 25 of the device 20. Each auxiliary passage has a size and/or shape such as to obtain an elastic grip on the respective cable or conductor 27; for example, it may be shaped like a hole with a diameter smaller than the diameter of said cable or conductor. As may be noted in FIG. 8, the visible conductor 27 is connected to a terminal 73, here of a male-faston type, associated in a way fixed to the body portion 46*a* of the connector 46. The visible conductor 27, associated to the terminal 73, is connected at the other end to the solenoid valve 21. Similar connectors and conductors can be provided for connection of sensor means 21*a* of the device 20.

The connector 46 is completed with a closing lid 74, fitted on the open end of the body portion 46*a*.

For the purposes of coupling, the male connector 46 is inserted in the female connector 45, so that:

the body portion 46*b* of the connector 46 will be inserted in the cavity part 47 of the body portion 45*b* of the connector 45. In this way, the gasket 62 provides a seal between the wall 61 of the portion 46*b* and the cylindrical outer wall of the portion 45*b*. The front end area of the insert 65 is moreover inserted in a sealed way, thanks to the gasket 68, within the seat 52 formed by the cylindrical internal wall 51;

the body portion 46*a* of the connector 46 will be partially inserted in the respective cavity part of the body portion 45*a* of the connector 45, there being obtained, with said insertion, coupling between the electrical terminals 73 of the connector 46 with the electrical terminals 56 of the connector 45.

The mechanical fixing between the parts can be further improved by providing, between the male and female connectors 45, 46, appropriate means of engagement/release of a type in itself known (for example, elastic tabs with teeth for engagement on one connector, and respective seats for engagement on the other connector), designed to guarantee mutual coupling of the connectors themselves, for example, such as to withstand the force exerted by the pressure of the water or accidental tensile forces exerted on the tube 25.

The arrangement is such that, in the coupled condition of the connectors 45-46:

the tube 24 of the device 20 is in hydraulic communication just with the tubing 24*a*, via the through cavity 49*a* of the projection 49 and that of the insert 65, the end of which is inserted in a sealed way in the seat 52;

the gap 26 between the tubes 24 and 25 of the device 20 is in hydraulic communication just with the tube T, via the cavities 69, 71 of the connector 46, the axial passages present between the tabs 64 and 66 of the insert 65, the axial passages present between the reliefs 63 of the connector 46, the cavity part 47*a* that surrounds the seat 52 of the connector 45, and finally the passage 55;

the terminals 56 and 73, respectively of the female connector 45 and of the male connector 46, are electrically coupled together.

As may be seen, then, the system of connectors described is such as to guarantee the presence of two distinct hydraulic pipes, one provided for flow of the normal water for direct supply to the refrigerator 1, and the other provided for collection and conveyance of possible water leaking from the tube for supply 24.

As has been said, the conductors 57 associated to the terminals 56 are connected to an electrical supply circuit, of a type in itself known, governed by the control system of the refrigerator 1 for the purpose of providing, when required, a supply voltage, via the conductors 27 of the device 20, to the solenoid valve 21 of the latter. It may be noted that the connectors 45, 46 can, if need be, comprise terminals in addition to the ones for supply and/or control of the device 20, such as terminals connected to other wires or cables coming under sensors, associated to the device 20 and connected to the circuit for control of the refrigerator. In such a perspective, for example, the device 20 can comprise a turbine flow sensor, designated by 21*a* in FIG. 3 and represented just schematically, designed to detect an anomalous flow of water when the solenoid valve 21 should be closed, or else a leakage sensor operating within the gap 26, which in this case could also be closed at the two ends, or not provided for conveying leakage water into the tray 32.

In the case where it is becomes necessary to top up the tank 12, the control system of the refrigerator 1 enables supply of the solenoid valve 21 of the device 20, via the conductors 57, 27 and in the ways and times necessary (see the foregoing description), with the water coming from the tube 24 that can reach just the tubing 24*a* for supply of the tank 12. On the other hand, in the case of failure of the tube 24 of the device 20, the leakage water collected by the outer tube 25 may reach just the tube T, for being conveyed thereby within the tray 32 of FIG. 7. The presence of the seal element 72 in the male connector 46 prevents any passage of leakage water in the area in which the electrical terminals 56, 73 are housed, and/or any outflow of water from the device 20.

From what has been described with reference to FIGS. 6-9 it emerges how, according to the variant proposed, the refrigerating apparatus 1 according to the invention may be interfaced to the supply device 20 in a simple and fast way, from the electrical, hydraulic and mechanical standpoints. Furthermore, as has been seen, the means for connecting the refrigerating apparatus 1 and the water system 13 integrate at least part of the anti-flooding safety means with which the apparatus itself is equipped.

In a further possible embodiment, the means used for detecting the level of liquid collected within at least one of the trays of the system of protection against flooding of the apparatus can be at least partially integrated in the tray itself. For this purpose, FIGS. 10-13 illustrate the case of at least partial integration of level sensor means of an optical type in a tray 33, i.e., the tray positioned underneath the tank 12.

Figure 10:
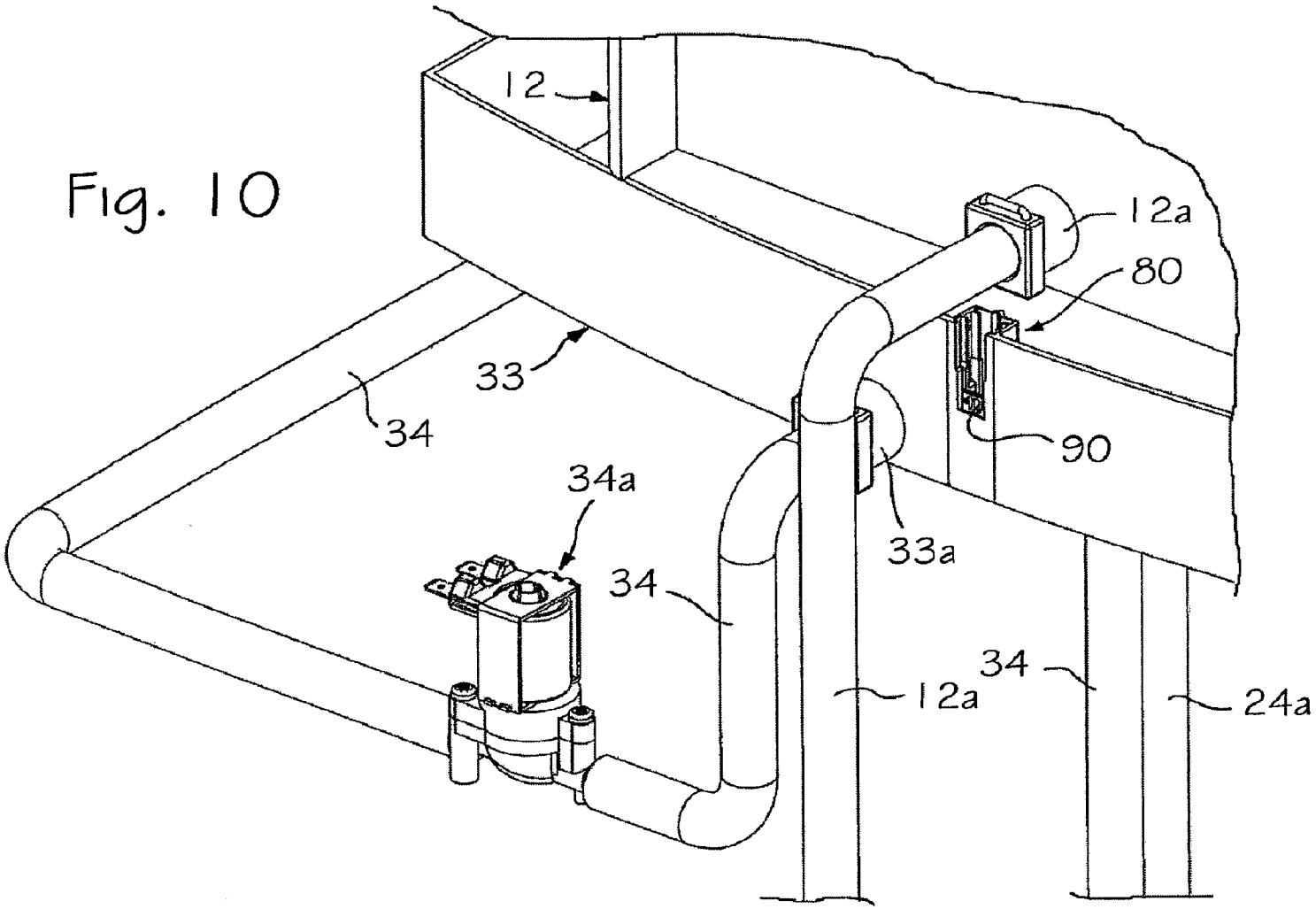
FIG. 10 is a perspective view of a part of an apparatus provided in accordance with another variant of the invention.

In FIG. 10, said tray 33 is visible just partially, with part of the corresponding tank 12. In this embodiment, provided along the tubing 34 is a shutoff means for intercepting the liquid, herein constituted by a solenoid valve 34*a*, of a normally closed type, controlled by the control system of the refrigerator 1.

Made in the front wall of the tray 33 is a hollow housing, designated as a whole by 80, positioned within which is a sensor device, designated as a whole by 90. The housing 80 can advantageously be made of a single piece with the rest of the tray 33, preferably during moulding of a single piece, or else be configured as a distinct component, assembled on the tray, or again as a part overmoulded on the tray. Irrespective of the type of embodiment, at least part of the housing 80 is made of transparent material.

Figure 11:
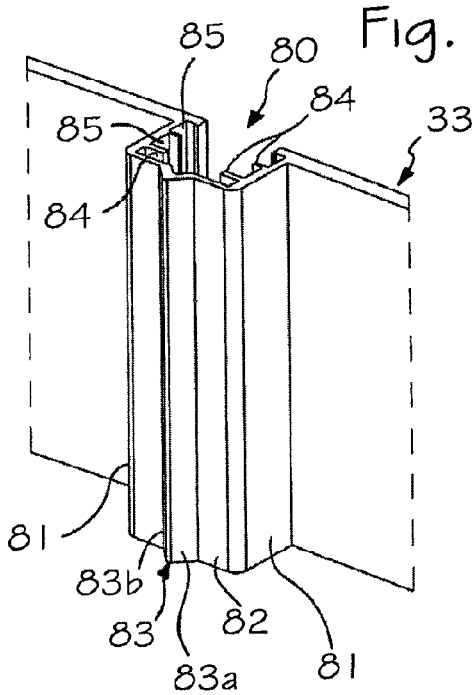
FIGS. 11 and 12 are perspective views of two different components of the apparatus of FIG. 10.

As may be seen in FIG. 11, in the case exemplified, the housing 80 is open both upwards and towards the outside of the tray 33. For this purpose, the housing 80 is delimited by two side walls 81, opposite and/or parallel to one another, which extend in a direction substantially perpendicular from the front wall of the tray 33 towards the inside thereof. The walls 81 are joined together by means of a transverse rear wall 82, having a central portion 83 that performs functions of optical prism. For this purpose, the wall 82 and/or at least its central portion 83 is made of transparent material. The portion 83 can have, as in the example represented, a substantially V-shaped cross section, constituted by two contiguous walls 83*a* and 83*b*, which form between them a right angle. The portion 83 extends in the direction of the height of the wall 82, and its vertex faces the inside of the tray 33. It may be noted that the prism-like portion 83 could also have a triangular cross section as a whole (i.e., "full"), instead of a V-shaped one, as in the case exemplified herein, or be of a different shape, which is in any case designed for the purposes described hereinafter.

Projecting from each wall 81, within the housing 80, are longitudinal reliefs 84, so as to form one or more positioning grooves 85.

Figure 12:
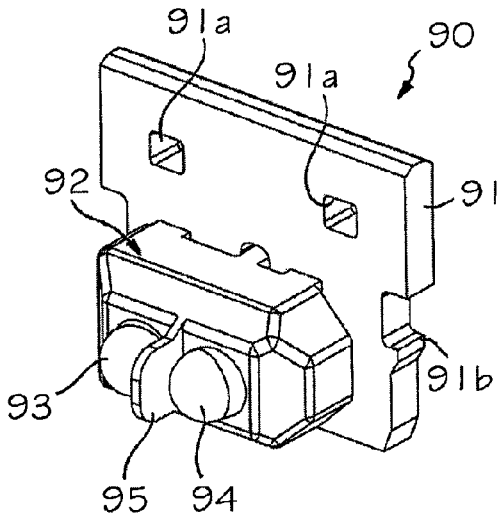

FIG. 12 illustrates an example of embodiment of the sensor device 90, which has a supporting element or printed circuit 91, substantially configured as a small plate, on which is mounted a sensor body 92. Associated to the front part of the body 92 are an emitter and a receiver of electromagnetic or optical radiation, designated respectively by 93 and 94, consisting, for example, of an emitter diode and a receiver photodiode or photo-transistor, respectively. In the example, the body 92 has at the front a projecting wall 95, which is set between the emitter 93 and the receiver 94, in particular for the purpose of preventing any anomalous interference between the two.

Figure 13:
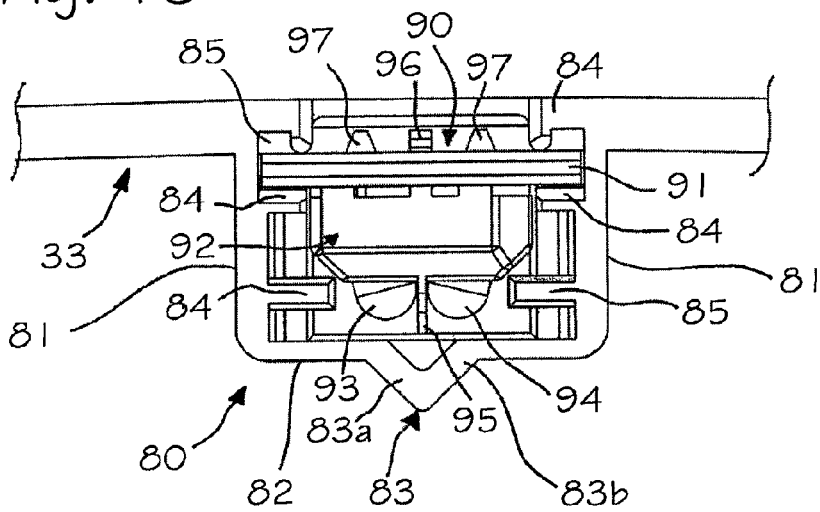
FIG. 13 is a plan view of the components of FIGS. 11 and 12 assembled together.

The body 92 is conveniently equipped with means for positioning or for fast coupling with respect to the circuit 91, said means being designated by 96 in FIG. 13 and has, in its rear area, electrical connection terminals, some soldering points of which are designated as a whole by 97 once again in FIG. 13. The electrical-connection means are made to pass through openings provided in the circuit 91 so as to project from the rear part of the element itself for connection to the control system of the refrigerator 1, which occurs with a wiring of a type in itself known (not represented). For this purpose, the printed circuit 91, on the side of the soldering points 97, has also electrically conductive paths, which form the terminals of a connector for the electrical wiring, in particular a male connector that is inserted in a respective female connector of the wiring. In order to guarantee mutual mechanical coupling between said connectors, the printed circuit 91 can present holes 91*a* (see FIG. 12), where purposely provided reliefs of said female connector are provided, in order to prevent them from sliding out following upon application of an accidental tensile force. For the purposes of installation, the sensor 90 is inserted from above in the housing 80, by sliding opposite side portions of the printed circuit 91 in facing grooves 85 formed by the reliefs 84. The body part 92 bearing the emitter 93 and the receiver 94 is set facing the rear wall 82 of the housing 80, with the connection terminals on the opposite side, in a position corresponding to the axial opening of the housing itself. Following upon said positioning, the front partition wall 95 of the body 91 is substantially in line with the vertex of the prism-like portion 83, the emitter 93 and the receiver 94 being set in a position corresponding to, or facing, the walls 83*a* and 83*b*, respectively.

For the purposes of operation of the detection system, the radiation in the form of light emitted by the emitter 93 reaches the wall 83*a* and traverses it. In the absence of water within the tray 33, or in the presence of a water level lower than the position of the components 93, 94, the radiation is reflected, substantially at right angles, from the wall 83*a* to the wall 83*b*, and then again reflected, once again at right angles, from the wall 83*b* as far as the receiver 94. Said reflection is due to the different index of refraction of the material constituting the prism-like portion 83 and of the medium that is located within the tray 33, i.e., air. It may be noted that the prism-like portion 83 and the sensor 90 are designed in a specific way so that, in the aforesaid condition (absence of water in the tray 33 at a level higher than the diodes 93, 94), the aforesaid reflection of radiation occurs as far as the receiver 94. In the condition described, then, the continuity of the signal detected by the receiver 94 represents, for the control system of the apparatus 1, the absence of a water-leakage level or a level that could be potentially harmful within the tray 33. Instead, in the presence of water in the tray 33 at a level higher than the position of the components 93, 94, at the interface between the water and the wall 83*a* there does not occur reflection at 90° of the radiation emitted by the diode 93, or such as to produce excitation of the photo-diode 94. In other words, supposing, for example, that the index of refraction of the material constituting the prism 83 is identical to that of water, the radiation emitted will proceed within the tray 33, through the water. In the case of non-identical indices of refraction between said material and water, the radiation may possibly be reflected, but in any case not in such a way as to enable excitation of the receiver 94.

The positioning in height of the sensor 90 within the respective housing 80 will be chosen as a function of the level considered critical. For this purpose, there could be provided a number of housings 80 in one and the same tray, or else a number of seats or positioning points at different heights within one and the same housing 80, to enable better predefinition of an adjustment of the working position of the sensor, particularly in the stage of production or assembly of the device. In such a perspective, the printed circuit 91 can be appropriately shaped, for example, with side reliefs 91*b* (see FIG. 12), designed to operate by engaging in purposely provided positioning seats of the housing 80.

Also sensor means of a different type or of an optical type having a configuration different from the one exemplified in FIGS. 10-13 may be associated to the tray 33. For example, said optical means could comprise an emitter on one side of the tray 33 aligned axially to a receiver on the opposite side of the tray, the system being configured in the design stage so that the radiation emitted by the former will reach the latter just when between them—and consequently within the tray—water is not present or is at a level lower than a pre-set safety threshold.

Of course, sensor means of an optical type of the types described above or of some other type could be associated to the tray 32 or 36 of the refrigerator according to the invention, instead of the float detector 37, 38.

The system of protection against flooding referred to in the example of embodiment of FIGS. 10-13 functions as described in what follows. In the case of leakage or overflowing from the tank 12, the water reaches the tray 33. If the level of the leakage water collected exceeds a given safety threshold, given by the position in height of the sensor 90 within the housing 80, the control system of the refrigerator 1 in the first place inhibits opening or brings about closing of the valve or valves of the supply device 20 in order to prevent in any case further inflow of water into the tank 12. In addition to this, the control system governs opening of the valve 34*a* of FIG. 10, so that the water collected by the tray 33 may be emptied into the sewage system, in the ways already described previously or else as in the embodiment of the subsequent FIGS. 14 and 15. Obviously, the aforesaid steps of operation, indicated by way of non-limiting example, could occur with different sequences and/or be in part omitted, particularly in the case of a different configuration of the system.

Figure 14:
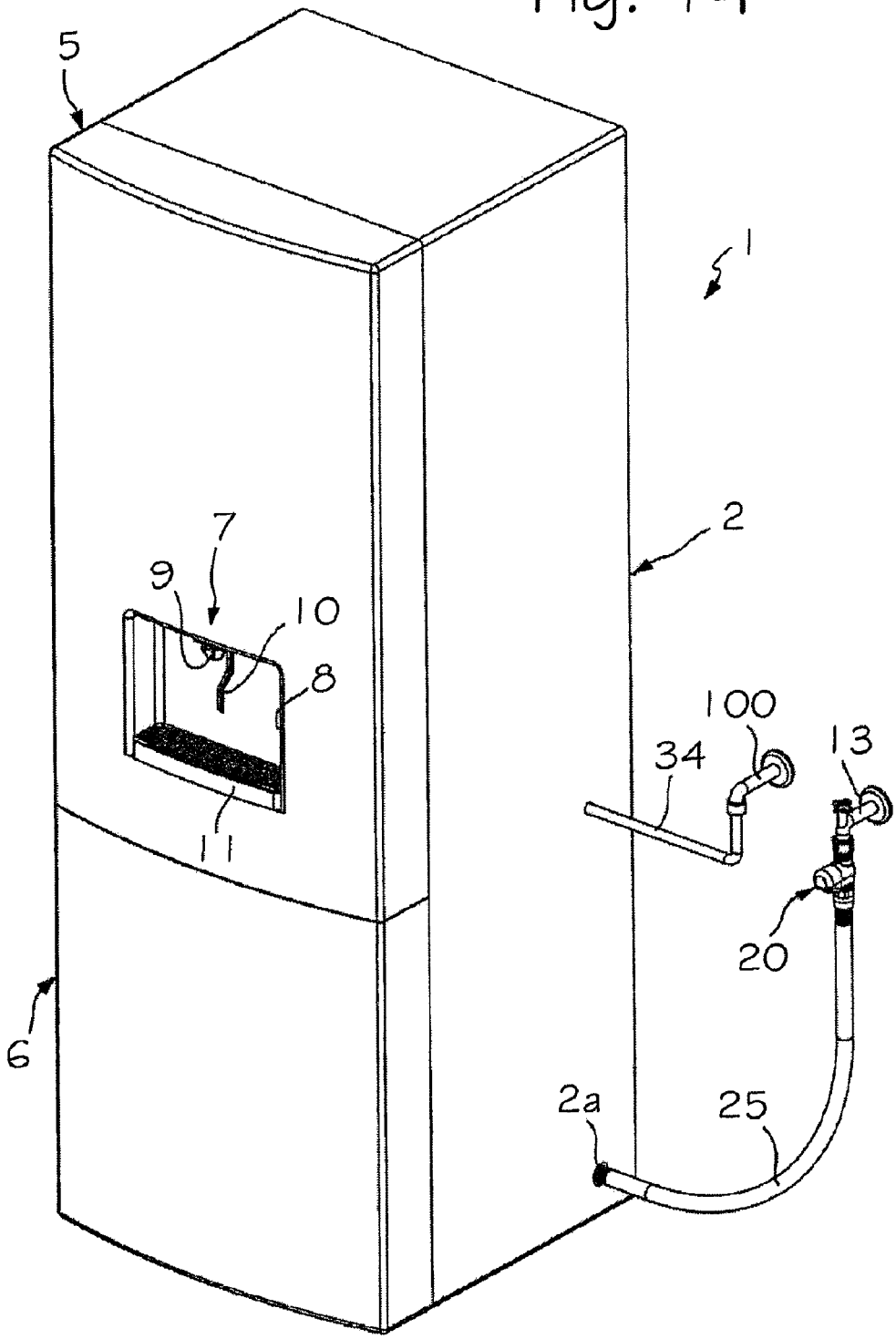
FIG. 14 is a schematic perspective view of an apparatus provided in accordance with a further variant of the invention.
Figure 15:
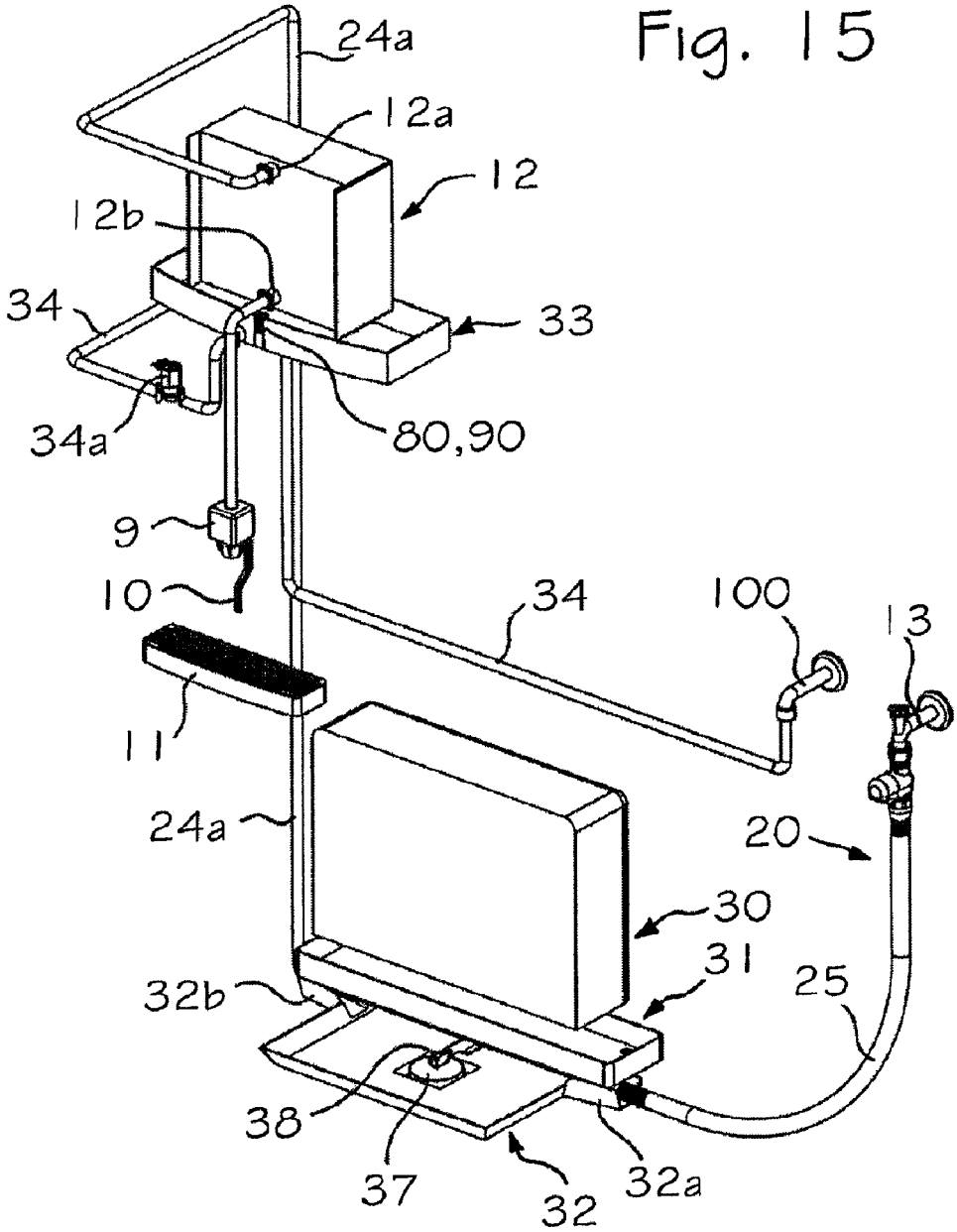
FIG. 15 is a schematic perspective view of a protection system with which the apparatus of FIG. 14 is equipped.

FIGS. 14 and 15 are schematic illustrations of a further possible embodiment of the invention, in accordance with which the leakage water collected by the protection system is evacuated from the apparatus 1 by gravity alone, i.e., without any need for a purposely provided discharge pump. As may be noted, in the case of the variant of FIGS. 14 and 15, the tray 33 associated to the tank 12 is equipped with the optical detection system 80, 90 (appearing in the previous FIGS. 10-13), provided on the tubing 34 is the valve 34*a*, and the tubing 34 is connected directly to a connector of the sewage system, herein designated by 100. As may be understood, in this case when the optical system 80, 90 detects a potentially harmful level of water in the tray 33, the control system of the refrigerator 1 enables opening of the valve 34*a*. The leakage water can then flow by gravity from the tray 33 to the connector 100, via the tubing 34. A condition necessary for operation of the system illustrated in FIG. 15 is that the tray 33 should be located at a greater height than the connector 100, which in any case could also be at floor level.

FIGS. 14 and 15 moreover present a simplified embodiment of the invention, preferred in the case where the tank 12 is of a type that can be topped up manually by the user and hence without any need to provide the supply device 20 and one or more of the collecting trays 32, 36. Obviously there is nothing to rule out combination between them of characteristics proper to the various possible variant embodiments described previously. Consequently, the solution of FIGS. 14 and 15, with evacuation by gravity of the leakage water, could be used also on an apparatus with a tank 12 topped up automatically, and hence equipped with the supply device 20, co-operating with a tray 32 and/or 36 equipped with its own detection means for controlling, if need be, closing of the valve 21.

From the above description, it emerges how the invention enables prevention of any risk of flooding deriving from possible malfunctioning of a liquid-supply system that equips a refrigerating apparatus, particularly forming part of an arrangement for dispensing a liquid-based consumable product, such as a beverage, water, or ice cubes. On the other hand, according to an independent innovative aspect of the invention, the protection system described may be used to advantage in other apparatus having doors or hatches in which liquids are made to pass or are accumulated.

Other aspects of the invention that may be subject to independent protection are the integration of at least one part of an optical sensor (in particular an optical prism) in a tray or a basin for collecting leakage liquid of a system for protection against flooding, irrespective of the type of apparatus on which the latter is used, as well as a system of connectors for a refrigerating apparatus integrating a respective part of anti-flooding safety means.

The level sensor means associated to one or more of the trays of the protection system can also be of a type different from the one described previously. For example, in addition to a float/microswitch one or one of an optical type, the sensor means can be of the float/magnetic sensor type, or again of the type that uses, as detection means, element made of anhydrous-sponge, of soluble material or of other material that can vary in volume when it comes into contact with a liquid, to bring about consequent switching of an electrical microswitch.

Also the trays or means for collecting the leakage of the liquid may, if need be, have shapes and/or arrangements different from the ones described by way of example.

The variation in volume of an anhydrous-sponge element or other material can be used also to bring about mechanical switching of an accumulator of mechanical or pneumatic energy, such as a spring actuator, which may exert a thrust or else a tensile force with respect to a controlled element, which could in particular be a mechanical valve, instead of an electrical one. In such a perspective, then, the interconnection means 45, 46 described previously could be configured for this purpose, including, for example, means of pneumatic connection or means of mechanical transmission, designed to transfer a command or movement of a type different from the electrical one.

In a possible variant (not represented), the solenoid valve 21 responsible for managing topping-up of the tank 12 with water can be located within the refrigerator, instead of integrated in the supply device 20. In such a variant, the supply device 20 can in any case be equipped with a mechanical safety valve, actuated in closing following upon detection of leakage within the refrigerator. The system for detection of leakage may in this case comprise an anhydrous-sponge element, variation of volume of which, following upon contact with leakage water, brings about switching of the aforementioned mechanical actuator, which is connected to the valve via a suitable transmission means. The element made of sponge and the mechanical actuator can be positioned directly in the tray 32, 33 or 36, and the transmission means, for example, a Bowden cable or the like, can extend within the gap 26 of the device 20, or else also outside its tube 25, to be connected to the mechanical valve. The detection of water performed by the sponge element brings about actuation of the mechanical actuator, with consequent closing of the mechanical safety valve associated to the supply device 20.

In the embodiments previously exemplified, the arrangement for dispensing beverages is associated to a door or hatch of the respective apparatus 1. It is, however, clear that in other embodiments, said arrangement could be associated either totally or in part to the fixed structure of the apparatus itself, i.e., to its cabinet 2.

In accordance with a further variant, one or more compartments 3, 4 of the refrigerator have a respective bottom wall, which is slightly funnel-shaped, with a corresponding discharge hole connected to a tubing, which is in turn connected, either directly or indirectly, to a tray of the type previously designated by 36. The aforesaid hole is normally occluded by a plug, which is manually removable in the event of operations of cleaning or washing of the compartment that are periodically carried out by the user. In this way, the water used for washing can be made to converge in the aforesaid tray, and from there be evacuated via the discharge tube 39 and the pump 40 and/or the solenoid valve 34*a*, 41. The refrigerator 1 can for this purpose be equipped with a control means, such as a push-button or a switch, for controlling the pump 40 and/or the solenoid valve 34*a*, 41, irrespective of the operating condition of the detection device 37, 38.

As already mentioned, possible intermediate joints and/or connectors of the various pipings described extend preferably above basins or collection trays, which are envisaged by the anti-flooding safety system according to the invention, or else are positioned within conveying channels having a function substantially similar to that of the outer tube 25 of the device 20.

The safety system according to the invention can also be conceived to enable alternative execution of discharge of the leakage water in a forced way, via a pump of the type like the one previously designated by 40, or else just by gravity, according to the position in height of the collection trays with respect to the connector to the sewage system. In such a case, the system can advantageously envisage means of selection of the mode of discharge to be adopted, said means possibly being of a type that can be set manually in the stage of installation of the apparatus 1, or else comprises automatic detection means (such as a flow sensor in the discharge pipe, designed to detect any outflow by gravity of leakage liquid).

FIGS. 16-18 illustrate a possible system of connectors for fluids, comprising in particular at least one sensor designed to detect whether connection and/or engagement has been made between the connectors themselves. Designated by 145 and 146 in said figures are two hydraulic connectors, respectively female and male, arranged for mutual coupling. The female connector 145 comprises a pipe or an inner cavity 145*a*, which may receive in a sealed way at least part of the male connector 146. Provided in the inlet stretch of the connector 145 is a seat of transverse sliding 145*b*, slidably mounted within which is an engagement element or slider 147. The slider 147 has a main passage 147*a* and a top slit 147*b*. Irrespective of the position of the slider 147, a substantial portion of the passage 147*a* is located always within the cavity 145*a* of the female connector 145, whilst the slit 147*b* is located on the outside thereof. The slider 147 is biased by an elastic element, herein represented by a spiral spring 148, which is operative for pushing the slider itself downwards or towards a position of engagement. The male connector 146 is equipped with a pipe or an inner through cavity 146*a* and has an end for coupling with an at least in part flared front surface 146*b*, for example, substantially having the shape of a truncated cone. The connector 146 has means of radial seal, herein represented by a seal ring 146*c*, and a peripheral groove 146*d*.

The end region of the slider 147, in which the slit 147*b* is present, may be set between an emitter and a receiver of electromagnetic or optical radiation, designated respectively by 149*a* and 149*b*, provided, for example, by an emitter diode and by a receiver photo-diode or photo-transistor forming part of an optical detector 149.

As may be seen in FIG. 16, with the connector 146 not inserted in the connector 145, the spring 148 keeps the slider 147 in a lowered position, in which the passage 147*a* extends in any case in part on the inside of the cavity 145*a*, whilst a full part of the top region of the slider 147 is set between the emitter 149*a* and the receiver 149*b* so as to prevent the radiation emitted by the former from reaching the latter. FIG. 17 illustrates the case of just partial insertion of the male connector 146 in the female connector 145. As emerges therefrom, by virtue of its cross section having the shape of a truncated cone, the tip of the connector 146 can penetrate into the part of passage 147*a* of the slider 147 inside the cavity 145*a* so that, with advance of the connector itself, the inclined surface 146*b* will produce raising of the slider 147, in opposition to the elastic reaction of the spring 148. Alternatively, the slider 147 can also be raised or displaced manually by exertion of a tensile force or a thrust on the ends projecting from the female connector 145. The connector 146 can then slide towards the inside of the connector 145, with the slider 147 that can bestride also the ring 146*c*, the latter enabling fluid-tight seal between the parts 145 and 146 to be obtained, even though the latter are not yet mechanically constrained to one another in a secure position. The situation illustrated in FIG. 17 is comparable with the one in which the connector 146 has been inserted correctly in the respective coupling seat of the connector 145, but the two parts have not been correctly engaged to one another. When subjected to the pressure of the fluid, the male and female parts of the connection system could then slide out of one another, with consequent leakage. As in the case of FIG. 16, in the condition of FIG. 17, a full part of the top region of the slider 147 is set between the emitter 149*a* and the receiver 149*b* so as to prevent the radiation emitted by the former from reaching the latter.

Finally, FIG. 18 illustrates the condition of proper mechanical coupling between the parts of the connection system, obtained when the connector 146 is inserted in the connector 145 until the groove 146*d* of the former is aligned with the groove 145*b* of the latter, with the slider 147 that can then drop, thanks to the action of the spring 148, to engage in said groove 146*d* of the former. In this condition, operation is guaranteed both by the fluid-tight seal, via the gasket 146*c*, and the mechanical connection, thanks to engagement between the slider 147 carried by the connector 145 and the connector 146. As emerges clearly, in said condition the slit 147*b* comes to be aligned between the emitter 149*a* and the receiver 149*b*, so that the radiation emitted by the former will reach the latter. The excitation of the receiver 149*b* becomes in this way indicative, for the control system of the apparatus, of proper coupling between the connectors 145 and 146. Obviously, at an electronic level, the states of the optical detector 149 could be reversed with respect to what was exemplified previously, for instance, with the various parts just described sized so that the excitation of the receiver 149*b* occurs in the absence of a real connection, whilst the interruption of the optical signal is indicative of the fact that effective connection has been made.

FIGS. 19 and 20 illustrate a further embodiment of a connection system with sensor, designed to detect that the connection and/or engagement has been made. Said figures use the reference numbers of FIGS. 16-18 to designate elements that are technically equivalent to the ones already described above. In this case, associated to the male connector 146 is a projection 150, which has a stretch 150*a* that extends substantially parallel to the axis of coupling between the connectors. In this embodiment, the excitation of the receiver 149*b* by the radiation emitted by the emitter 149*a* is indicative of the absence of a connection, i.e., of a coupling between the connectors 145 and 146, as exemplified in FIG. 19. Instead, as appears from FIG. 20, in the case of proper coupling between the connectors 145 and 146, the stretch 150*a* of the projection 150 sets itself between the emitter and the receiver. The consequent interruption of the optical signal thus becomes indicative, for the control system of the apparatus, of the fact that connection has been made between the parts.

The detector 149 could be of a type different from the optical one, for example, of a magnetic type, in which a permanent magnet is associated to the slider 147 or to the projection 150, said magnet being designed to excite a respective magnetic sensor, such as a Hall sensor or a magnetic contact or reed, at the moment in which proper engagement occurs between the two connectors 145 and 146. The connection system according to the variant of FIGS. 19 and 20 could be further equipped with means that enable the position of FIG. 19 to be reached just in the case where a given condition of engagement between the connectors has occurred (said means could, for example, comprise a slider and a groove of a type like the ones designated by 147 and 146*d* in FIGS. 16-18), or that in said position automatic engagement of the two connectors certainly has occurred.

The system for checking the hydraulic-mechanical connection (but, of course, it could also be a connection of an electrical type and/or of some other type), described and illustrated with reference to FIGS. 16-20, can conveniently be applied to the connectors 45, 46 of FIGS. 6-9, as well as to the unions or joints 12*a*, 12*b* and 33*a* of FIGS. 4, 5, 10, 15. More in general, the system for checking the connection is suited for being associated to connectors for fluids, which are subject to actions carried out by users, and hence to a higher risk of wrong connection, as in the case of tanks and/or trays subject to being temporarily removed from a generic apparatus, for the purposes of filling, cleaning, maintenance, etc. Said system is likewise suited to being associated to connectors of the so-called "fast" type, for the purpose of detecting faults of operation or of engagement, which are otherwise hard to perceive by a user who is not particularly attentive. This checking system may obviously be applicable in combination with various other types of electrical household appliances and components used in combination with fluids, such as safety devices to prevent flooding, valves, flow sensors, and so forth.

The invention claimed is:

1. A refrigerating apparatus, having a liquid-supply system for a user device belonging to the apparatus, the apparatus comprising a protection system arranged for preventing flooding deriving from a leakage of liquid from at least one of said supply system and said user device, wherein the protection system comprises at least one from among:

a container for collecting liquid leaking from the user device;

a tray arranged for collecting liquid leaking from a container for accumulating the liquid or tank, a tray arranged for collecting liquid leaking from a pipe forming part of at least one of said supply system and said user device;

a basin, to which said tray is hydraulically connected;

a peripheral pipe that surrounds at least partially a pipe of at least one of said supply system and said user device;

a peripheral pipe that surrounds at least partially a discharge pipe;

a basin, in which said peripheral pipe is designed to convey leakage liquid;

liquid-detection means, operatively associated to at least one of said tray and said basin;

a discharge pipe arranged for evacuating liquid leaking from the apparatus;

means of forced discharge, arranged for evacuating liquid leaking from the apparatus;

shutoff means operating along a pipe for supply of the liquid;

shutoff means operating along a pipe in which leakage liquid passes;

a connection pipe set between a first container and a second container for collecting leakage liquid;

interconnection means for connecting together two distinct portions of a pipe for passage of liquid;

interconnection means operative for connecting together two distinct portions of said peripheral pipe;

interconnection means arranged for mutual mechanical and/or hydraulic and/or electrical coupling; and means for checking a state of coupling of interconnection means.

2. The apparatus according to claim 1, wherein the supply system comprises at least one from among:

a container for accumulating the liquid, or tank;

a pipe for supply of the liquid, designed to be connected to a water-supply system external to the apparatus;

a container for accumulating the liquid, or tank, supplied via a supply pipe which can be connected to a water system external to the apparatus, shutoff means operating along a pipe for supply of the liquid; and interconnection means, for connecting together in a sealed way two distinct portions of a pipe for passage of liquid.

3. The apparatus according to claim 1, wherein the supply system comprises a container for accumulating the liquid, or tank, and the protection system comprises a collection container, or tray, set underneath the tank and in the proximity thereof, the tray being arranged for collecting liquid leaking from the tank.

4. The apparatus according to claim 3, wherein connected to the tray is a pipe for evacuation of the leakage liquid collected by the tray.

5. The apparatus according to claim 4, wherein the evacuation pipe is configured as a tube for discharge by gravity and is arranged for direct or indirect connection to a system for water discharge external to the apparatus.

6. The apparatus according to claim 5, wherein provided along the evacuation pipe is a shutoff means and/or operatively associated to the tray are detection means for detecting leakage liquid.

7. The apparatus according to claim 1, wherein the supply system comprises a pipe for supply of the liquid, or first pipe, which can be connected to a water-supply system external to the apparatus, and the protection system comprises a second pipe that encloses at least in part the first pipe, between the first pipe and the second pipe there being defined a gap, designed to receive leakage liquid that comes out of the first pipe.

8. The apparatus according to claim 7, wherein the second pipe is arranged for conveying the leakage liquid received in said gap into a collection container, or basin, operatively positioned within the apparatus.

9. The apparatus according to claim 7, wherein the supply system comprises a container for accumulating the liquid, or tank, to which said supply pipe is connected, and the protection system comprises a second collection container, or tray, set underneath the tank and in the proximity thereof, the tray being arranged for collecting liquid leaking from the tank and being in turn connected, via an evacuation pipe, to the basin.

10. The apparatus according to claim 1, wherein the protection system comprises a basin that is in hydraulic communication with a discharge tube arranged for connection to a discharge system external to the apparatus.

11. The apparatus according to claim 1, wherein the protection system comprises a basin, operatively associated to which are detection means for detecting leakage liquid, used for the purposes of control of at least one of a means of forced discharge and a shutoff means.

12. The apparatus according to claim 1, wherein the protection system comprises a first hydraulic connector and a second hydraulic connector arranged for mutual coupling, each connector defining two distinct hydraulic passages, the passages of one connector being connected in a sealed way to the passages of the other connector following upon the coupling between the two connectors.

13. The apparatus according to claim 1, wherein a substantial part of the protection system is associated to a door of the apparatus.

14. The apparatus according to claim 3, wherein at least said tank and said tray are in a door of the apparatus.

15. The apparatus according to claim 4, wherein the evacuation pipe is connected to a further collection container, or basin and connected to said basin is at least one of:

a tray set underneath a liquid dispenser; and a tray arranged for collecting condensate liquid caused following upon a step of defrosting of the apparatus.

16. The apparatus according to claim 1, wherein a pipe of at least one from among said supply system, user device and protection system is equipped with means of connection or joining comprising a first part and a second part, which can undergo mutual mechanical and/or hydraulic and/or electrical coupling, with associated sensor or detection means for verifying a state of said coupling.

17. An apparatus that uses a liquid, having a fixed structure, associated in a movable way to which is at least one door, the apparatus having a liquid-supply system for a user device, where at least one substantial part of at least one of said supply system and said user device is carried by said door, wherein the apparatus further comprises a protection system arranged for preventing flooding deriving from a leakage of liquid from at least one of said supply system and said user device, wherein the protection system comprises at least one from among:

a container for collecting liquid leaking from the user device;

a tray arranged for collecting liquid leaking from a container for accumulating the liquid or tank, a tray arranged for collecting liquid leaking from a pipe forming part of at least one of said supply system and said user device;

a basin, to which said tray is hydraulically connected;

a peripheral pipe that surrounds at least partially a pipe of at least one of said supply system and said user device;

a peripheral pipe that surrounds at least partially a discharge pipe;

a basin, in which said peripheral pipe is designed to convey leakage liquid;

liquid-detection means, operatively associated to at least one of said tray and said basin;

a discharge pipe arranged for evacuating liquid leaking from the apparatus;

means of forced discharge, arranged for evacuating liquid leaking from the apparatus;

shutoff means operating along a pipe for supply of the liquid;

shutoff means operating along a pipe in which leakage liquid passes;

a connection pipe set between a first container and a second container for collecting leakage liquid;

interconnection means for connecting together two distinct portions of a pipe for passage of liquid;

interconnection means operative for connecting together two distinct portions of said peripheral pipe;

interconnection means arranged for mutual mechanical and/or hydraulic and/or electrical coupling; and means for checking a state of coupling of interconnection means;

and wherein the protection system comprises first protection means carried by said door.

18. The apparatus according to claim 17, wherein said protection system comprises at least one of additional protection means housed within said fixed structure and additional protection means extending at least partially outside of said fixed structure.

* * * * *